US009824536B2

(12) United States Patent
Shorrock et al.

(10) Patent No.: US 9,824,536 B2
(45) **Date of Patent: *Nov. 21, 2017**

(54) GAMING SYSTEM, GAMING DEVICE AND METHOD FOR UTILIZING MOBILE DEVICES AT A GAMING ESTABLISHMENT

(71) Applicant: IGT, Las Vegas, NV (US)

(72) Inventors: Michael Shorrock, San Anselmo, CA (US); Anthony J. Baerlocher, Henderson, NV (US); Mark C. Nicely, Daly City, CA (US)

(73) Assignee: IGT, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/354,617

(22) Filed: Nov. 17, 2016

(65) Prior Publication Data

US 2017/0069165 A1 Mar. 9, 2017

Related U.S. Application Data

(63) Continuation of application No. 13/622,736, filed on Sep. 19, 2012, now Pat. No. 9,524,609.

(60) Provisional application No. 61/541,217, filed on Sep. 30, 2011.

(51) Int. Cl.
*G07F 17/32* (2006.01)
*G07F 17/34* (2006.01)

(52) U.S. Cl.
CPC ..... *G07F 17/3244* (2013.01); *G07F 17/3223* (2013.01); *G07F 17/3225* (2013.01); *G07F 17/3239* (2013.01); *G07F 17/3251* (2013.01); *G07F 17/34* (2013.01)

(58) Field of Classification Search
CPC ... G07F 17/34; G07F 17/3244; G07F 17/3225
USPC ..... 463/25
See application file for complete search history.

(56) References Cited

U.S. PATENT DOCUMENTS

| | | | |
|---|---|---|---|
| 3,662,105 | A | 5/1972 | Parks |
| 3,708,219 | A | 1/1973 | Forlini et al. |
| 3,792,437 | A | 2/1974 | Blumenthal et al. |
| 3,931,504 | A | 1/1976 | Jacoby |
| 4,071,689 | A | 1/1978 | Talmage |
| 4,072,930 | A | 2/1978 | Lucero |
| 4,124,109 | A | 11/1978 | Bissell et al. |
| 4,218,011 | A | 8/1980 | Simjian |
| 4,283,709 | A | 8/1981 | Lucero |
| 4,333,715 | A | 6/1982 | Brooks |
| 4,339,709 | A | 7/1982 | Brihier |

(Continued)

FOREIGN PATENT DOCUMENTS

| | | |
|---|---|---|
| AU | 199650576 | 4/1997 |
| AU | 775882 | 8/2004 |

(Continued)

OTHER PUBLICATIONS

Extended European Search Report for EP Appl. 12185605.8, dated Dec. 2, 2013 (7 pages).

(Continued)

*Primary Examiner* — David L Lewis
*Assistant Examiner* — Shauna-Kay Hall
(74) *Attorney, Agent, or Firm* — Neal, Gerber & Eisenberg LLP

(57) ABSTRACT

A gaming system which facilitates the two-way communication between mobile devices, such as mobile phones, and different gaming system components to enhance a player's gaming experience.

20 Claims, 5 Drawing Sheets

(56) References Cited

U.S. PATENT DOCUMENTS 4,339,798 A 7/1982 Hedges
4,430,728 A 2/1984 Beitel et al.
4,454,594 A 6/1984 Heffron et al.
4,517,558 A 5/1985 Davids
4,553,222 A 11/1985 Kurland
4,607,844 A 8/1986 Fullerton
4,621,814 A 11/1986 Stepan et al.
4,659,182 A 4/1987 Aizawa
4,689,742 A 8/1987 Troy et al.
4,718,672 A 1/1988 Okada
4,856,787 A 8/1989 Itkis
4,911,449 A 3/1990 Dickinson et al.
4,912,548 A 3/1990 Shanker et al.
5,038,022 A 8/1991 Lucero
5,039,848 A 8/1991 Stoken
5,042,809 A 8/1991 Richardson
5,048,831 A 9/1991 Sides
5,086,354 A 2/1992 Bass et al.
5,097,981 A 3/1992 Degasperi et al.
5,113,272 A 5/1992 Reamey
5,132,839 A 7/1992 Travis
5,158,293 A 10/1992 Mullins
5,179,517 A 1/1993 Sarbin
5,221,838 A 6/1993 Gutman
5,265,874 A 11/1993 Dickinson et al.
5,290,033 A 3/1994 Bittner et al.
5,319,491 A 6/1994 Selbrede
5,342,047 A 8/1994 Heidel et al.
5,348,299 A 9/1994 Clapper, Jr.
5,364,100 A 11/1994 Ludlow et al.
5,371,345 A 12/1994 Lestrange
5,375,830 A 12/1994 Takemoto et al.
5,376,587 A 12/1994 Buchmann et al.
5,393,061 A 2/1995 Manship et al.
5,397,125 A 3/1995 Adams
5,408,417 A 4/1995 Wilder
5,429,361 A 7/1995 Raven
5,457,306 A 10/1995 Lucero
5,467,893 A 11/1995 Landis, II et al.
5,470,079 A 11/1995 Lestrange
5,483,049 A 1/1996 Schulze, Jr.
5,487,544 A 1/1996 Clapper, Jr.
5,489,096 A 2/1996 Aron
5,502,636 A 3/1996 Clarke
5,539,547 A 7/1996 Ishii et al.
5,559,312 A 9/1996 Lucero
5,580,055 A 12/1996 Hagiwara
5,585,821 A 12/1996 Ishikura et al.
5,589,980 A 12/1996 Bass et al.
5,609,337 A 3/1997 Clapper, Jr.
5,613,679 A 3/1997 Casa et al.
5,618,045 A 4/1997 Kagan
5,619,649 A 4/1997 Kovnat et al.
5,621,812 A 4/1997 Deaton et al.
5,628,684 A 5/1997 Bouedec
5,642,485 A 6/1997 Deaton et al.
5,643,086 A 7/1997 Alcorn et al.
5,645,485 A 7/1997 Clapper, Jr.
5,647,592 A 7/1997 Gerow
5,655,961 A 8/1997 Acres et al.
5,676,231 A 10/1997 Legras
5,702,304 A 12/1997 Acres
5,709,603 A 1/1998 Kaye
5,718,632 A 2/1998 Hayashi
5,722,890 A 3/1998 Libby et al.
5,741,183 A 4/1998 Acres
5,745,197 A 4/1998 Leung et al.
5,749,784 A 5/1998 Clapper, Jr.
5,752,881 A 5/1998 Inoue
5,759,102 A 6/1998 Pease
5,761,647 A 6/1998 Boushy
5,764,317 A 6/1998 Sadnovik et al.
5,768,382 A 6/1998 Schneier
5,769,716 A 6/1998 Saffari
5,770,533 A 6/1998 Franchi
5,779,545 A 7/1998 Berg
5,785,594 A 7/1998 Seibert et al.
5,788,573 A 8/1998 Baerlocher
5,795,228 A 8/1998 Trumbull
5,796,389 A 8/1998 Bertram
5,797,085 A 8/1998 Beuk
5,809,482 A 9/1998 Strisower
5,811,772 A 9/1998 Lucero
5,816,918 A 10/1998 Kelly
5,818,019 A 10/1998 Irwin, Jr.
5,833,536 A 11/1998 Davids
5,833,540 A 11/1998 Miodunski
5,836,819 A 11/1998 Ugawa
5,851,148 A 12/1998 Brune
5,851,149 A 12/1998 Xidos et al.
5,871,398 A 2/1999 Schneier
D406,612 S 3/1999 Johnson
5,885,158 A 3/1999 Torango
5,910,046 A 6/1999 Wada et al.
5,919,091 A 7/1999 Bell et al.
5,923,307 A 7/1999 Hogle, IV
5,928,082 A 7/1999 Clapper, Jr.
5,934,671 A 8/1999 Harrison
5,941,773 A 8/1999 Harlick
5,951,397 A 9/1999 Dickinson
5,952,640 A 9/1999 Lucero
5,954,583 A 9/1999 Green
5,956,180 A 9/1999 Bass et al.
5,957,776 A 9/1999 Hoehne
5,959,277 A 9/1999 Lucero
5,967,893 A 10/1999 Lawrence et al.
5,967,896 A 10/1999 Jorasch
5,971,271 A 10/1999 Wynn
5,984,779 A 11/1999 Bridgeman
5,999,808 A 12/1999 Ladue
6,001,016 A 12/1999 Walker et al.
6,003,013 A 12/1999 Bohy
6,003,651 A 12/1999 Waller
6,010,404 A 1/2000 Walker
6,012,832 A 1/2000 Saunders
6,012,983 A 1/2000 Walker
6,015,346 A 1/2000 Bennett
6,019,283 A 2/2000 Lucero
6,027,115 A 2/2000 Griswold et al.
6,038,666 A 3/2000 Hsu
6,048,269 A 4/2000 Burns
6,050,895 A 4/2000 Luciano, Jr. et al.
6,054,969 A 4/2000 Haisma
6,059,658 A 5/2000 Mangano et al.
6,062,981 A 5/2000 Luciano, Jr.
6,068,552 A 5/2000 Walker et al.
6,077,163 A 6/2000 Walker
6,089,975 A 7/2000 Dunn
6,099,408 A 8/2000 Schneier et al.
6,104,815 A 8/2000 Alcorn et al.
6,106,396 A 8/2000 Alcorn et al.
6,110,041 A 8/2000 Walker et al.
6,113,098 A 9/2000 Adams
6,113,492 A 9/2000 Walker
6,113,493 A 9/2000 Walker
6,113,495 A 9/2000 Walker et al.
6,135,884 A 10/2000 Luciano et al.
6,135,887 A 10/2000 Pease
6,139,431 A 10/2000 Walker
6,141,711 A 10/2000 Shah
6,142,369 A 11/2000 Jonstromer
6,149,522 A 11/2000 Alcorn et al.
6,159,098 A 12/2000 Slomiany et al.
6,161,059 A 12/2000 Tedesco
6,162,121 A 12/2000 Morro
6,162,122 A 12/2000 Acres
6,174,234 B1 1/2001 Seibert, Jr.
6,182,221 B1 1/2001 Hsu
6,183,362 B1 2/2001 Bohy
6,190,256 B1 2/2001 Walker et al.
6,193,608 B1 2/2001 Walker et al.
6,206,283 B1 3/2001 Bansal
6,210,279 B1 4/2001 Dickinson
6,213,875 B1 4/2001 Suzuki

(56) References Cited

U.S. PATENT DOCUMENTS

| | | | |
|---|---|---|---|
| 6,223,166 | B1 | 4/2001 | Kay |
| 6,227,972 | B1 | 5/2001 | Walker |
| 6,244,596 | B1 | 6/2001 | Kondratjuk |
| 6,244,958 | B1 | 6/2001 | Acres |
| 6,247,643 | B1 | 6/2001 | Lucero |
| 6,251,014 | B1 | 6/2001 | Stockdale et al. |
| 6,252,707 | B1 | 6/2001 | Kleinberger et al. |
| 6,253,119 | B1 | 6/2001 | Dabrowski |
| 6,253,374 | B1 | 6/2001 | Dresevic et al. |
| 6,254,481 | B1 | 7/2001 | Jaffe |
| 6,264,560 | B1 | 7/2001 | Goldberg |
| 6,264,561 | B1 | 7/2001 | Saffari |
| 6,267,671 | B1 | 7/2001 | Hogan |
| 6,270,410 | B1 | 8/2001 | Demar |
| 6,280,328 | B1 | 8/2001 | Holch |
| 6,285,868 | B1 | 9/2001 | Ladue |
| 6,293,866 | B1 | 9/2001 | Walker et al. |
| 6,302,790 | B1 | 10/2001 | Brossard |
| 6,307,956 | B1 | 10/2001 | Black |
| 6,312,332 | B1 | 11/2001 | Walker et al. |
| 6,315,666 | B1 | 11/2001 | Mastera et al. |
| 6,319,125 | B1 | 11/2001 | Acres |
| 6,337,513 | B1 | 1/2002 | Clevenger et al. |
| 6,341,353 | B1 | 1/2002 | Herman |
| 6,347,996 | B1 | 2/2002 | Gilmore et al. |
| 6,368,216 | B1 | 4/2002 | Hedrick et al. |
| 6,371,852 | B1 | 4/2002 | Acres |
| 6,378,073 | B1 | 4/2002 | Davis |
| 6,379,244 | B1 | 4/2002 | Sagawa et al. |
| 6,379,246 | B1 | 4/2002 | Dabrowski |
| 6,383,076 | B1 | 5/2002 | Tiedeken |
| 6,398,220 | B1 | 6/2002 | Inoue |
| 6,409,595 | B1 | 6/2002 | Uihlein |
| 6,409,602 | B1 | 6/2002 | Wiltshire |
| 6,416,827 | B1 | 7/2002 | Chakrapani et al. |
| 6,443,843 | B1 | 9/2002 | Walker |
| 6,444,496 | B1 | 9/2002 | Edwards et al. |
| 6,445,185 | B1 | 9/2002 | Damadian et al. |
| 6,446,257 | B1 | 9/2002 | Pradhan et al. |
| 6,449,687 | B1 | 9/2002 | Moriya |
| 6,450,885 | B2 | 9/2002 | Schneier et al. |
| 6,453,319 | B1 | 9/2002 | Mattis et al. |
| 6,454,648 | B1 | 9/2002 | Kelly et al. |
| 6,488,585 | B1 | 12/2002 | Wells |
| 6,491,583 | B1 | 12/2002 | Gauselmann |
| 6,496,928 | B1 | 12/2002 | Deo |
| 6,503,147 | B1 | 1/2003 | Stockdale et al. |
| 6,511,375 | B1 | 1/2003 | Kaminkow |
| 6,512,559 | B1 | 1/2003 | Hashimoto et al. |
| 6,514,141 | B1 | 2/2003 | Kaminkow et al. |
| 6,517,433 | B2 | 2/2003 | Loose et al. |
| 6,517,437 | B1 | 2/2003 | Wells et al. |
| 6,530,835 | B1 | 3/2003 | Walker |
| 6,547,664 | B2 | 4/2003 | Saunders |
| 6,561,903 | B2 | 5/2003 | Walker |
| 6,575,541 | B1 | 6/2003 | Hedrick et al. |
| 6,581,161 | B1 | 6/2003 | Byford |
| 6,582,310 | B1 | 6/2003 | Walker |
| 6,585,589 | B2 | 7/2003 | Okuniewicz |
| 6,585,591 | B1 | 7/2003 | Baerlocher et al. |
| 6,585,598 | B2 | 7/2003 | Nguyen |
| 6,620,047 | B1 | 9/2003 | Alcorn et al. |
| 6,628,939 | B2 | 9/2003 | Paulsen |
| D480,961 | S | 10/2003 | Deadman |
| 6,634,550 | B1 | 10/2003 | Walker et al. |
| 6,645,077 | B2 | 11/2003 | Rowe |
| 6,646,695 | B1 | 11/2003 | Gauselmann |
| 6,648,761 | B1 | 11/2003 | Izawa et al. |
| 6,652,378 | B2 | 11/2003 | Cannon et al. |
| 6,659,864 | B2 | 12/2003 | McGahn et al. |
| 6,661,425 | B1 | 12/2003 | Hiroaki |
| 6,676,522 | B2 | 1/2004 | Rowe |
| 6,682,421 | B1 | 1/2004 | Rowe |
| 6,685,567 | B2 | 2/2004 | Cockerille |
| 6,695,703 | B1 | 2/2004 | McGahn |
| 6,702,670 | B2 | 3/2004 | Jasper |
| 6,702,675 | B2 | 3/2004 | Poole et al. |
| 6,712,694 | B1 | 3/2004 | Nordman |
| 6,715,756 | B2 | 4/2004 | Inoue |
| 6,717,728 | B2 | 4/2004 | Putilin |
| 6,722,979 | B2 | 4/2004 | Gilmore et al. |
| 6,739,975 | B2 | 5/2004 | Nguyen |
| 6,758,393 | B1 | 7/2004 | Luciano |
| 6,800,029 | B2 | 10/2004 | Rowe |
| 6,802,777 | B2 | 10/2004 | Seelig et al. |
| 6,811,486 | B1 | 11/2004 | Luciano, Jr. |
| 6,817,945 | B2 | 11/2004 | Seelig et al. |
| 6,817,946 | B2 | 11/2004 | Motegi et al. |
| 6,846,238 | B2 | 1/2005 | Wells |
| 6,869,362 | B2 | 3/2005 | Walker |
| 6,880,079 | B2 | 4/2005 | Kefford et al. |
| 6,887,157 | B2 | 5/2005 | LeMay et al. |
| 6,890,259 | B2 | 5/2005 | Breckner et al. |
| 6,896,618 | B2 | 5/2005 | Benoy |
| 6,905,411 | B2 | 6/2005 | Nguyen |
| 6,906,762 | B1 | 6/2005 | Witehira et al. |
| 6,913,534 | B2 | 7/2005 | Defrees-Parrott et al. |
| 6,937,298 | B2 | 8/2005 | Okada |
| 6,969,319 | B2 | 11/2005 | Rowe et al. |
| 6,997,803 | B2 | 2/2006 | Lemay et al. |
| 7,004,388 | B2 | 2/2006 | Kohta |
| 7,004,837 | B1 | 2/2006 | Crowder, Jr. |
| 7,022,017 | B1 | 4/2006 | Halbritter et al. |
| 7,095,180 | B2 | 8/2006 | Emslie et al. |
| 7,097,560 | B2 | 8/2006 | Okada |
| 7,128,647 | B2 | 10/2006 | Muir et al. |
| 7,153,210 | B2 | 12/2006 | Yamagishi |
| 7,159,865 | B2 | 1/2007 | Okada |
| 7,160,187 | B2 | 1/2007 | Loose et al. |
| 7,167,724 | B2 | 1/2007 | Yamagishi |
| 7,198,571 | B2 | 4/2007 | LeMay et al. |
| 7,204,753 | B2 | 4/2007 | Ozaki et al. |
| 7,207,883 | B2 | 4/2007 | Nozaki et al. |
| 7,220,181 | B2 | 5/2007 | Okada |
| 7,252,288 | B2 | 8/2007 | Seelig et al. |
| 7,255,643 | B2 | 8/2007 | Ozaki et al. |
| 7,275,991 | B2 | 10/2007 | Burns |
| 7,309,284 | B2 | 12/2007 | Griswold et al. |
| 7,322,884 | B2 | 1/2008 | Emori et al. |
| 7,329,181 | B2 | 2/2008 | Hoshino et al. |
| 7,331,520 | B2 | 2/2008 | Silva |
| 7,335,106 | B2 | 2/2008 | Johnson |
| 7,337,330 | B2 | 2/2008 | Gatto |
| 7,341,522 | B2 | 3/2008 | Yamagishi |
| 7,416,485 | B2 | 8/2008 | Walker et al. |
| 7,419,428 | B2 | 9/2008 | Rowe |
| 7,467,999 | B2 | 12/2008 | Walker et al. |
| 7,477,889 | B2 | 1/2009 | Kim |
| 7,510,474 | B2 | 3/2009 | Carter, Sr. |
| 1,545,522 | A1 | 6/2009 | Lou |
| 7,552,341 | B2 | 6/2009 | Chen |
| 7,594,855 | B2 | 9/2009 | Meyerhofer |
| 7,611,409 | B2 | 11/2009 | Muir |
| 7,618,319 | B2 | 11/2009 | Casey et al. |
| 7,619,585 | B2 | 11/2009 | Bell et al. |
| 7,644,861 | B2 | 1/2010 | Alderucci |
| 7,686,687 | B2 | 3/2010 | Cannon et al. |
| 7,730,413 | B1 | 6/2010 | Engel et al. |
| 7,753,789 | B2 | 7/2010 | Walker et al. |
| 7,758,420 | B2 | 7/2010 | Saffari |
| 7,771,271 | B2 | 8/2010 | Walker et al. |
| 7,785,193 | B2 | 8/2010 | Paulsen |
| 7,846,017 | B2 | 12/2010 | Walker et al. |
| 7,850,522 | B2 | 12/2010 | Walker et al. |
| 7,883,417 | B2 | 2/2011 | Bruzzese |
| 7,918,734 | B2 | 4/2011 | Gould |
| 7,950,996 | B2 | 5/2011 | Nguyen |
| 7,972,213 | B2 | 7/2011 | Walker et al. |
| 7,997,972 | B2 | 8/2011 | Nguyen et al. |
| 8,016,666 | B2 | 9/2011 | Angell |
| 8,023,133 | B2 | 9/2011 | Kaneko |
| 8,029,351 | B2 | 10/2011 | Kosaka et al. |
| 8,038,527 | B2 | 10/2011 | Walker et al. |
| 8,070,590 | B2 | 12/2011 | Cannon et al. |

(56) References Cited

U.S. PATENT DOCUMENTS 8,087,996 B2 1/2012 Walker et al.
8,096,872 B2 1/2012 Walker et al.
8,131,649 B2 3/2012 Yen et al.
8,157,642 B2 4/2012 Paulsen
8,192,276 B2 6/2012 Walker et al.
8,220,019 B2 7/2012 Stearns et al.
8,360,865 B2 1/2013 Walker et al.
8,419,526 B1 4/2013 Cannon et al.
8,500,546 B2 8/2013 Walker et al.
8,512,139 B2 8/2013 Williams et al.
8,512,144 B2 8/2013 Johnson et al.
8,678,916 B2 3/2014 Cannon et al.
2001/0013681 A1 8/2001 Bruzzese et al.
2001/0039204 A1 11/2001 Tanskanen
2001/0044337 A1 11/2001 Rowe et al.
2002/0020603 A1 2/2002 Jones
2002/0045472 A1 4/2002 Adams
2002/0061778 A1 5/2002 Acres
2002/0077182 A1 6/2002 Swanberg
2002/0082070 A1 6/2002 Macke
2002/0087641 A1 7/2002 Levosky
2002/0090986 A1 7/2002 Cote
2002/0094869 A1 7/2002 Harkham
2002/0107066 A1 8/2002 Seelig
2002/0111206 A1 8/2002 Van Bbaltz
2002/0111209 A1 8/2002 Walker
2002/0111210 A1 8/2002 Luciano, Jr. et al.
2002/0142825 A1 10/2002 Lark et al.
2002/0142846 A1 10/2002 Paulsen
2002/0145035 A1 10/2002 Jones
2002/0147047 A1 10/2002 Letovsky
2002/0147049 A1 10/2002 Carter, Sr.
2002/0163570 A1 11/2002 Phillips
2002/0169623 A1 11/2002 Call
2002/0173354 A1 11/2002 Winans et al.
2002/0183046 A1 12/2002 Joyce
2002/0183105 A1 12/2002 Cannon et al.
2002/0194505 A1 12/2002 Muschenborn
2002/0196342 A1 12/2002 Walker
2003/0003988 A1 1/2003 Walker et al.
2003/0008707 A1 1/2003 Walker
2003/0027624 A1 2/2003 Gilmore et al.
2003/0027632 A1 2/2003 Sines
2003/0032478 A1 2/2003 Takahama et al.
2003/0032479 A1 2/2003 LeMay et al.
2003/0032485 A1 2/2003 Cockerille
2003/0045354 A1 3/2003 Giobbi
2003/0054868 A1 3/2003 Paulsen
2003/0054881 A1 3/2003 Hedrick
2003/0064771 A1 4/2003 Morrow et al.
2003/0064801 A1 4/2003 Breckner
2003/0064805 A1 4/2003 Wells
2003/0069074 A1 4/2003 Jackson
2003/0074259 A1 4/2003 Slyman, Jr.
2003/0083126 A1 5/2003 Paulsen
2003/0083943 A1 5/2003 Adams et al.
2003/0087690 A1 5/2003 Loose et al.
2003/0092477 A1 5/2003 Luciano, Jr.
2003/0104865 A1 6/2003 Itkis
2003/0130028 A1 7/2003 Aida et al.
2003/0141359 A1 7/2003 Dymovsky
2003/0144052 A1 7/2003 Walker
2003/0148812 A1 8/2003 Paulsen
2003/0162582 A1 8/2003 Gordon
2003/0162591 A1 8/2003 Nguyen
2003/0172037 A1 9/2003 Jung
2003/0176214 A1 9/2003 Burak et al.
2003/0186734 A1 10/2003 Lemay
2003/0186739 A1 10/2003 Paulsen
2003/0199321 A1 10/2003 Williams
2003/0203756 A1 10/2003 Jackson
2003/0216961 A1 11/2003 Barry
2003/0222876 A1 12/2003 Giemborek et al.
2003/0224852 A1 12/2003 Walker
2003/0228900 A1 12/2003 Yamagishi
2003/0236114 A1 12/2003 Griswold et al.
2004/0009813 A1 1/2004 Wind
2004/0014514 A1 1/2004 Yacenda
2004/0016797 A1 1/2004 Jones
2004/0023714 A1 2/2004 Asdale
2004/0023721 A1 2/2004 Giobbi
2004/0029636 A1 2/2004 Wells
2004/0039635 A1 2/2004 Linde
2004/0043814 A1 3/2004 Angell
2004/0048671 A1 3/2004 Rowe
2004/0063490 A1 4/2004 Okada
2004/0066475 A1 4/2004 Searle
2004/0085293 A1 5/2004 Soper
2004/0087360 A1 5/2004 Chamberlain et al.
2004/0103444 A1 5/2004 Weinberg et al.
2004/0106454 A1 6/2004 Walker
2004/0110557 A1 6/2004 Rowe
2004/0116178 A1 6/2004 Okada
2004/0117484 A1 6/2004 Singer et al.
2004/0127277 A1 7/2004 Walker
2004/0127284 A1 7/2004 Walker et al.
2004/0129773 A1 7/2004 Lute, Jr.
2004/0147303 A1 7/2004 Imura et al.
2004/0147314 A1 7/2004 Lemay
2004/0150162 A1 8/2004 Okada
2004/0162146 A1 8/2004 Ooto
2004/0166925 A1 8/2004 Emori et al.
2004/0171423 A1 9/2004 Silva et al.
2004/0180712 A1 9/2004 Forman et al.
2004/0180721 A1 9/2004 Rowe
2004/0183972 A1 9/2004 Bell
2004/0185935 A1 9/2004 Yamagishi
2004/0190042 A1 9/2004 Ferlitsch
2004/0192430 A1 9/2004 Burak et al.
2004/0192434 A1 9/2004 Walker
2004/0198485 A1 10/2004 Loose
2004/0199284 A1 10/2004 Hara
2004/0207154 A1 10/2004 Okada
2004/0208126 A1 10/2004 Wassew et al.
2004/0209666 A1 10/2004 Okada et al.
2004/0209667 A1 10/2004 Emori et al.
2004/0209668 A1 10/2004 Okada
2004/0209671 A1 10/2004 Okada
2004/0209678 A1 10/2004 Okada
2004/0209683 A1 10/2004 Okada
2004/0209690 A1 10/2004 Bruzzese et al.
2004/0214635 A1 10/2004 Okada
2004/0214637 A1 10/2004 Nonaka
2004/0219968 A1 11/2004 Fiden
2004/0224747 A1 11/2004 Okada
2004/0225565 A1 11/2004 Selman
2004/0233663 A1 11/2004 Emslie et al.
2004/0239582 A1 12/2004 Seymour
2004/0254010 A1 12/2004 Fine
2004/0259640 A1 12/2004 Gentles
2004/0266395 A1 12/2004 Pailles
2005/0014554 A1 1/2005 Walke
2005/0020348 A1 1/2005 Thomas et al.
2005/0020354 A1 1/2005 Nguyen
2005/0020358 A1 1/2005 Cram
2005/0032571 A1 2/2005 Asonuma
2005/0037843 A1 2/2005 Wells et al.
2005/0043086 A1 2/2005 Schneider
2005/0049032 A1 3/2005 Kobayashi
2005/0049046 A1 3/2005 Kobayashi
2005/0049049 A1 3/2005 Griswold
2005/0054438 A1 3/2005 Rothschild
2005/0059480 A1 3/2005 Soukup et al.
2005/0059485 A1 3/2005 Paulsen
2005/0059494 A1 3/2005 Kammler
2005/0062410 A1 3/2005 Bell et al.
2005/0063055 A1 3/2005 Engel
2005/0070257 A1 3/2005 Saarinen
2005/0076242 A1 4/2005 Breuer
2005/0079913 A1 4/2005 Inamura
2005/0085292 A1 4/2005 Inamura
2005/0101383 A1 5/2005 Wells
2005/0119052 A1 6/2005 Russell et al.
2005/0130728 A1 6/2005 Nguyen

(56) References Cited

U.S. PATENT DOCUMENTS

2005/0153772 A1 7/2005 Griswold et al.
2005/0153775 A1 7/2005 Griswold et al.
2005/0153776 A1 7/2005 LeMay et al.
2005/0164762 A1 7/2005 Smith et al.
2005/0192090 A1 9/2005 Muir et al.
2005/0193269 A1 9/2005 Haswell et al.
2005/0206582 A1 9/2005 Bell et al.
2005/0208994 A1 9/2005 Berman
2005/0215311 A1 9/2005 Hornik et al.
2005/0227770 A1 10/2005 Papulov
2005/0233799 A1 10/2005 LeMay et al.
2005/0239539 A1 10/2005 Inamura
2005/0240484 A1 10/2005 Yan
2005/0255911 A1 11/2005 Nguyen
2005/0266912 A1 12/2005 Sekiguchi
2005/0282638 A1 12/2005 Rowe
2005/0285337 A1 12/2005 Durham et al.
2005/0287852 A1 12/2005 Sugawara
2006/0009273 A2 1/2006 Moshal
2006/0018450 A1 1/2006 Sandberg-Diment
2006/0019743 A1 1/2006 Roemer
2006/0025206 A1 2/2006 Walker
2006/0025222 A1 2/2006 Sekine
2006/0035707 A1 2/2006 Nguyen et al.
2006/0040741 A1 2/2006 Griswold
2006/0041586 A1 2/2006 Nassef
2006/0046823 A1 3/2006 Kaminkow
2006/0046834 A1 3/2006 Sekine
2006/0046842 A1 3/2006 Mattice
2006/0046855 A1 3/2006 Nguyen
2006/0049624 A1 3/2006 Brosnan
2006/0063581 A1 3/2006 Harris et al.
2006/0068898 A1 3/2006 Maya
2006/0079333 A1 4/2006 Morrow et al.
2006/0089174 A1 4/2006 Twerdahl
2006/0089194 A1 4/2006 Joshi et al.
2006/0094508 A1 5/2006 D'Amico et al.
2006/0100014 A1 5/2006 Griswold et al.
2006/0103951 A1 5/2006 Bell et al.
2006/0105837 A1 5/2006 Walker et al.
2006/0105841 A1 5/2006 Rom et al.
2006/0125745 A1 6/2006 Evanicky
2006/0135255 A1 6/2006 Roth
2006/0143085 A1 6/2006 Adams et al.
2006/0154729 A1 7/2006 LeMay et al.
2006/0160621 A1 7/2006 Rowe
2006/0165060 A1 7/2006 Dua
2006/0166727 A1 7/2006 Burak
2006/0166732 A1 7/2006 Lechner
2006/0166741 A1 7/2006 Boyd
2006/0173781 A1 8/2006 Donner
2006/0184626 A1 8/2006 Agapi et al.
2006/0189382 A1 8/2006 Muir et al.
2006/0190482 A1 8/2006 Kishan et al.
2006/0191177 A1 8/2006 Engel
2006/0217202 A1 9/2006 Burke et al.
2006/0218029 A1 9/2006 Chin
2006/0223627 A1 10/2006 Nozaki
2006/0226598 A1 10/2006 Walker
2006/0246981 A1 11/2006 Walker
2006/0247037 A1 11/2006 Park
2006/0264256 A1 11/2006 Gagner et al.
2006/0264257 A1 11/2006 Jaffe et al.
2006/0266598 A1 11/2006 Baumgartner
2006/0271433 A1 11/2006 Hughes
2006/0279781 A1 12/2006 Kaneko
2006/0281554 A1 12/2006 Gatto
2006/0282855 A1 12/2006 Margulis
2006/0284574 A1 12/2006 Emslie et al.
2006/0287072 A1 12/2006 Walker
2006/0287098 A1 12/2006 Morrow
2006/0290594 A1 12/2006 Engel et al.
2007/0004510 A1 1/2007 Underdahl et al.
2007/0004513 A1 1/2007 Wells et al.
2007/0004519 A1 1/2007 Swart
2007/0010315 A1 1/2007 Hein
2007/0015569 A1 1/2007 Norton et al.
2007/0017979 A1 1/2007 Wu
2007/0021198 A1 1/2007 Muir et al.
2007/0024002 A1 2/2007 McMain et al.
2007/0032288 A1 2/2007 Nelson et al.
2007/0043616 A1 2/2007 Kutaragi et al.
2007/0060302 A1 3/2007 Fabbri
2007/0060317 A1 3/2007 Martin
2007/0060372 A1 3/2007 Yamagishi
2007/0117608 A1 5/2007 Roper
2007/0117623 A1 5/2007 Nelson
2007/0129150 A1 6/2007 Crowder
2007/0159301 A1 7/2007 Hirl
2007/0180400 A1 8/2007 Zotov et al.
2007/0190494 A1 8/2007 Rosenberg
2007/0218971 A1 9/2007 Berube
2007/0218985 A1 9/2007 Okada
2007/0218991 A1 9/2007 Okada
2007/0238505 A1 10/2007 Okada
2007/0243925 A1 10/2007 LeMay et al.
2007/0243928 A1 10/2007 Iddings
2007/0243934 A1 10/2007 Little et al.
2008/0008188 A1 1/2008 Buga et al.
2008/0009344 A1 1/2008 Graham et al.
2008/0020816 A1 1/2008 Griswold et al.
2008/0020839 A1 1/2008 Wells et al.
2008/0020840 A1 1/2008 Wells et al.
2008/0020841 A1 1/2008 Wells et al.
2008/0026816 A1 1/2008 Sammon
2008/0026823 A1 1/2008 Wolf
2008/0026844 A1 1/2008 Wells
2008/0058065 A1 3/2008 Okada
2008/0076574 A1 3/2008 Okada
2008/0096655 A1 4/2008 Rasmussen et al.
2008/0113747 A1 5/2008 Williams et al.
2008/0123026 A1 5/2008 Kwag
2008/0125219 A1 5/2008 Williams et al.
2008/0213026 A1 9/2008 Grabiec
2008/0274798 A1 11/2008 Walker et al.
2008/0300049 A1 12/2008 Anderson et al.
2008/0305862 A1 12/2008 Walker
2008/0318655 A1 12/2008 Davies
2009/0098943 A1 4/2009 Weber et al.
2009/0104954 A1 4/2009 Weber et al.
2009/0125429 A1 5/2009 Takayama
2009/0156303 A1 6/2009 Kiely et al.
2009/0233705 A1 9/2009 LeMay et al.
2010/0105454 A1 4/2010 Weber et al.
2010/0113161 A1 5/2010 Walker et al.
2010/0219234 A1 9/2010 Forbes
2010/0227683 A1 9/2010 Walker et al.
2010/0240455 A1 9/2010 Gagner et al.
2010/0285859 A1 11/2010 Costa
2010/0304855 A1 12/2010 Acres
2011/0003642 A1 1/2011 Russell et al.
2011/0098104 A1 4/2011 Meyerhofer
2013/0017884 A1 1/2013 Price et al.
2013/0035157 A1 2/2013 Weber et al.
2013/0053144 A1 2/2013 Nicely
2013/0116041 A1 5/2013 Walker et al.
2013/0237314 A1 9/2013 Cannon et al.
2014/0221099 A1 8/2014 Johnson et al.

FOREIGN PATENT DOCUMENTS

EP 0454423 10/1991
EP 0484103 5/1992
EP 0 769 769 4/1997
EP 0769769 4/1997
EP 0997857 10/1999
EP 0727245 5/2000
EP 1195184 4/2002
EP 1255234 6/2002
EP 1255234 11/2002
EP 1260928 11/2002
EP 1282088 2/2003
EP 1462152 9/2004
EP 1492063 12/2004

(56) References Cited

FOREIGN PATENT DOCUMENTS

| | | |
|---|---|---|
| EP | 1524617 | 4/2005 |
| GB | 1464896 | 2/1977 |
| GB | 1559496 | 1/1980 |
| GB | 2120506 | 11/1983 |
| JP | 04220276 | 8/1992 |
| JP | 06043425 | 2/1994 |
| JP | 07124290 | 5/1995 |
| JP | 2000300729 | 10/2000 |
| JP | 00350805 | 12/2000 |
| JP | 01062032 | 3/2001 |
| JP | 01238995 | 9/2001 |
| JP | 01252393 | 9/2001 |
| JP | 01252394 | 9/2001 |
| JP | 02085624 | 3/2002 |
| JP | 2004089707 | 3/2004 |
| JP | 2004105616 | 4/2004 |
| JP | 04166879 | 6/2004 |
| JP | 2005253561 | 9/2005 |
| JP | 2005266387 | 9/2005 |
| JP | 2005266388 | 9/2005 |
| JP | 2005274906 | 10/2005 |
| JP | 2005274907 | 10/2005 |
| JP | 2005283864 | 10/2005 |
| JP | 2006346226 | 12/2006 |
| WO | 98/52665 | 11/1998 |
| WO | 99/42889 | 8/1999 |
| WO | 99/44095 | 9/1999 |
| WO | 01/09664 | 2/2001 |
| WO | 01/15127 | 3/2001 |
| WO | 01/15128 | 3/2001 |
| WO | 01/15132 | 3/2001 |
| WO | 0172387 | 10/2001 |
| WO | 02/21467 | 3/2002 |
| WO | 02/073501 | 9/2002 |
| WO | 03/023647 | 3/2003 |
| WO | WO 03/027970 | 4/2003 |
| WO | 03/039699 | 5/2003 |
| WO | 2004/001486 | 12/2003 |
| WO | 2004/102520 | 11/2004 |
| WO | 2006/033986 | 3/2006 |
| WO | 2006/034192 | 3/2006 |
| WO | 2006/038819 | 4/2006 |
| WO | 2006/039132 | 4/2006 |
| WO | 2006093146 | 9/2006 |
| WO | 2007/032916 | 3/2007 |
| WO | 2007/040413 | 4/2007 |
| WO | 2007/120444 | 10/2007 |
| WO | 2007/120450 | 10/2007 |
| WO | 2007117418 | 10/2007 |
| WO | 2008/061068 | 5/2008 |
| WO | 2009/009269 | 1/2009 |
| WO | 2009/036445 | 3/2009 |
| WO | 2009/140096 | 11/2009 |
| WO | 2009/143274 | 11/2009 |
| WO | 2010/056418 | 5/2010 |
| WO | 2010/120451 | 10/2010 |

OTHER PUBLICATIONS

Australian Office action dated Jul. 21, 2015 for Australian Patent Application No. 2012227288.

European Office Action dated Apr. 5, 2016 for European Application No. 12185605.8 (7 pages).

GAMING SYSTEM, GAMING DEVICE AND METHOD FOR UTILIZING MOBILE DEVICES AT A GAMING ESTABLISHMENT

PRIORITY CLAIM

This application is a continuation of, claims priority to and the benefit of U.S. patent application Ser. No. 13/622,736, filed on Sep. 19, 2012, which claims priority to and the benefit of U.S. Provisional Patent Application Ser. No. 61/541,217, filed on Sep. 30, 2011, the entire contents of which are each incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are available. Gaming machines may generally require the player to place or make a wager to activate the primary or base game. In many of these gaming machines, the award may be based on the player obtaining a winning symbol or symbol combination and on the amount of the wager (e.g., the higher the wager, the higher the award). Generally, symbols or symbol combinations which are less likely to occur usually provide higher awards. In such known gaming machines, the amount of the wager made on the base game by the player may vary.

Gaming machines which may provide secondary or bonus games are also available. The secondary or bonus games usually provide an additional award, such as a bonus award, to the player. Secondary or bonus games usually do not require an additional wager by the player to be activated. Instead, secondary or bonus games may generally be activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machine may generally indicate this triggering to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Available player tracking systems may enable gaming establishments to recognize the value of customer loyalty through identifying frequent and/or high wagering players and rewarding them for their patronage. The cumulative history of a particular player's gaming activity, which may be included in a player profile of a typical player tracking system, may enable gaming establishments to target individual players with direct marketing promotions or customized reward plans. In typically available player tracking systems, the gaming establishment may issue each participating player a player identification card which has an encoded player identification or player tracking account number that uniquely identifies that player. When the player may sit down at a gaming machine, the player may insert the player tracking card into a card reader which may send information or data to a player tracking system to identify the player and the player's player tracking account. Before or upon the player removing their player tracking card, the gaming machine may communicate information or data relating to the player's gaming session to the player tracking system. Upon the conclusion of the player's current gaming session, the player tracking system may update the player's player tracking account accordingly. Since different gaming establishments may each maintain a distinct player tracking account for a player (and thus may provide a distinct player tracking card to the player), players that frequent a plurality of different gaming establishments may need to carry a plurality of different player tracking cards with them. Accordingly, there is a continuing need to enable players that are enrolled in a plurality of player tracking systems to avoid having to carry a plurality of different player tracking cards.

Additionally, while available player tracking systems may reward identified players for their patronage, certain players may prefer to remain anonymous. These players must often forgo the marketing promotions and/or customized reward plans associated with identified players. That is, even if such unidentified players have comparable wagering activities to certain identified players (and may thus be comparably valued by a gaming establishment), the decision to remain anonymous may cause these unidentified to be treated differently by the gaming establishment. Accordingly, there is a continuing need to equate the customer loyalty values of both identified players (i.e., players who choose to enroll in a player tracking system) and unidentified or anonymous players (i.e., player who choose not to enroll in a player tracking system).

SUMMARY

The present disclosure relates generally to wagering gaming systems, gaming devices, and methods for employing mobile devices, such as mobile phones, at a gaming establishment.

In various embodiments, the gaming system disclosed herein facilitates the two-way communication between mobile devices, such as mobile phones, and different gaming system components to enhance a player's gaming experience. In different embodiments, the gaming system may enable a player's mobile or cellular phone, such as a smart phone, to communicate directly or indirectly with one or more target components of a gaming system, such as an individual gaming device, a player tracking system, a tournament manager or a gaming establishment reservation system. In these embodiments, the gaming system may enable a player's mobile phone to communicate with such target components of the gaming system via one or more codes (e.g., a mobile phone displayed barcode scanned by an individual gaming device), via one or more messaging services (e.g., text messages between a gaming establishment server and a mobile phone), and/or via one or more communication applications (e.g., an application running in a service window of a gaming device which communicates, over a data network, with an application running on a mobile phone).

In one embodiment, the gaming system may interact with one or more mobile phones to enable information or data from the gaming system to be stored by the mobile phone. In this embodiment, the gaming system may subsequently communicate with the mobile phone to access this stored information or data to activate one or more features for the player. In one such embodiment, the gaming system may associate a player's mobile phone with a player's player tracking account. In this embodiment, the player's mobile phone would operate as the player's playing tracking card (either at an individual gaming device or at a gaming table) to enable the player to avail themselves of the same player tracking related benefits available to other players that carry their player tracking card with them. Accordingly, in this embodiment, players that frequent a plurality of different gaming establishments and are enrolled in a plurality of player tracking systems may avoid having to carry a plurality of different player tracking cards.

In another embodiment, the gaming system may additionally or alternatively interact with one or more mobile phones to obtain and store information or data from the mobile phone. In one such embodiment, the gaming system may identify a mobile phone (but not necessarily any player associated with that mobile phone) and create an account associated with that mobile phone. Such an account may enable certain players (that do not want to volunteer their personal information to obtain a player tracking card) to avail themselves of the same player tracking related benefits available to other players that enroll in a player tracking system. Accordingly, in this embodiment, the gaming system equates the customer loyalty values of both identified players (i.e., players who choose to enroll in a player tracking system) and unidentified or anonymous players (i.e., player who choose not to enroll in a player tracking system).

Accordingly, the gaming system disclosed herein may incorporate the player's mobile phone into various activities associated with the player's gaming experience. Such incorporation provides both promotional benefits (i.e., enabling a unenrolled in a player tracking system to receive benefits associated with the player tracking system) and/or ease of use benefits (i.e., freeing the player from having to carry a plurality of different player tracking cards) to a player which thus increases a player's level of excitement and enjoyment.

Accordingly, one advantage of the gaming system disclosed herein is that it enables players to store and transfer game data between different gaming devices, even at different gaming establishments, without requiring a network sign-up (i.e., without requiring the player to remember various passwords).

Additional features and advantages are described herein, and will be apparent from the following Detailed Description and the figures.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which may be provided by the gaming machine or gaming device) may be provided with the gaming machine or gaming device prior to delivery to a gaming establishment; and (2) a changeable gaming machine, gaming device, or gaming system wherein the computerized instructions for controlling any games (which may be provided by the gaming machine or gaming device) may be downloadable to the gaming machine or gaming device through a data network after the gaming machine or gaming device is in a gaming establishment. In one embodiment, the computerized instructions for controlling any games may be executed by at least one central server, central controller, or remote host. In such a "thin client" embodiment, the central server remotely controls any games (or other suitable interfaces) and the gaming device may be utilized to display such games (or suitable interfaces) and receive one or more inputs or commands from a player. In another embodiment, the computerized instructions for controlling any games may be communicated from the central server, central controller, or remote host to a gaming device local processor and memory devices. In such a "thick client" embodiment, the gaming device local processor may execute the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device may be implemented in a thin client environment and certain other functions of the gaming device may be implemented in a thick client environment. In one such embodiment, computerized instructions for controlling any primary games may be communicated from the central server to the gaming device in a thick client configuration and computerized instructions for controlling any secondary games or bonus functions may be executed by a central server in a thin client configuration.

Figure 1A:
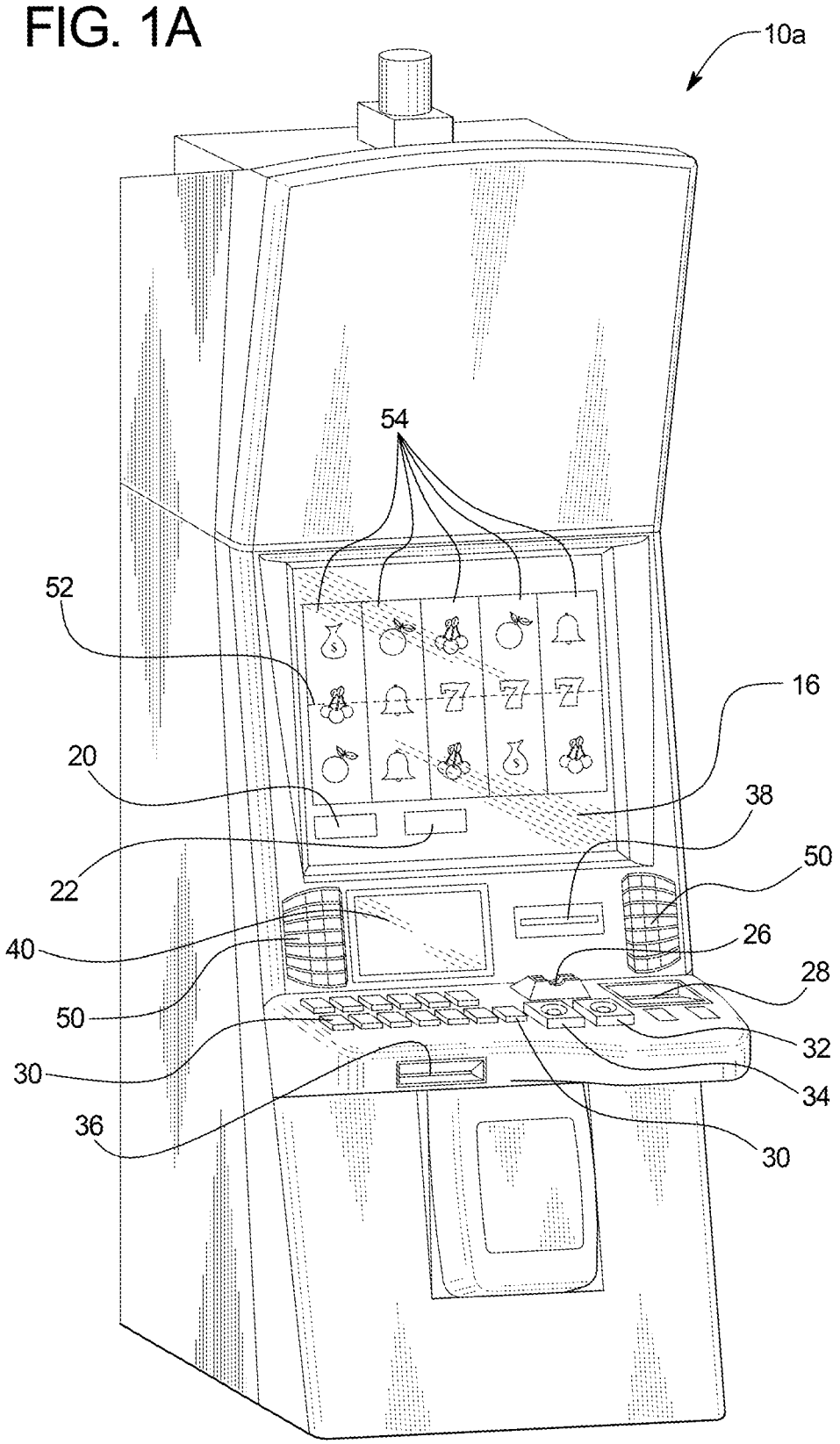
FIG. 1A is a front-side perspective view of one embodiment of the gaming device disclosed herein.
Figure 1B:
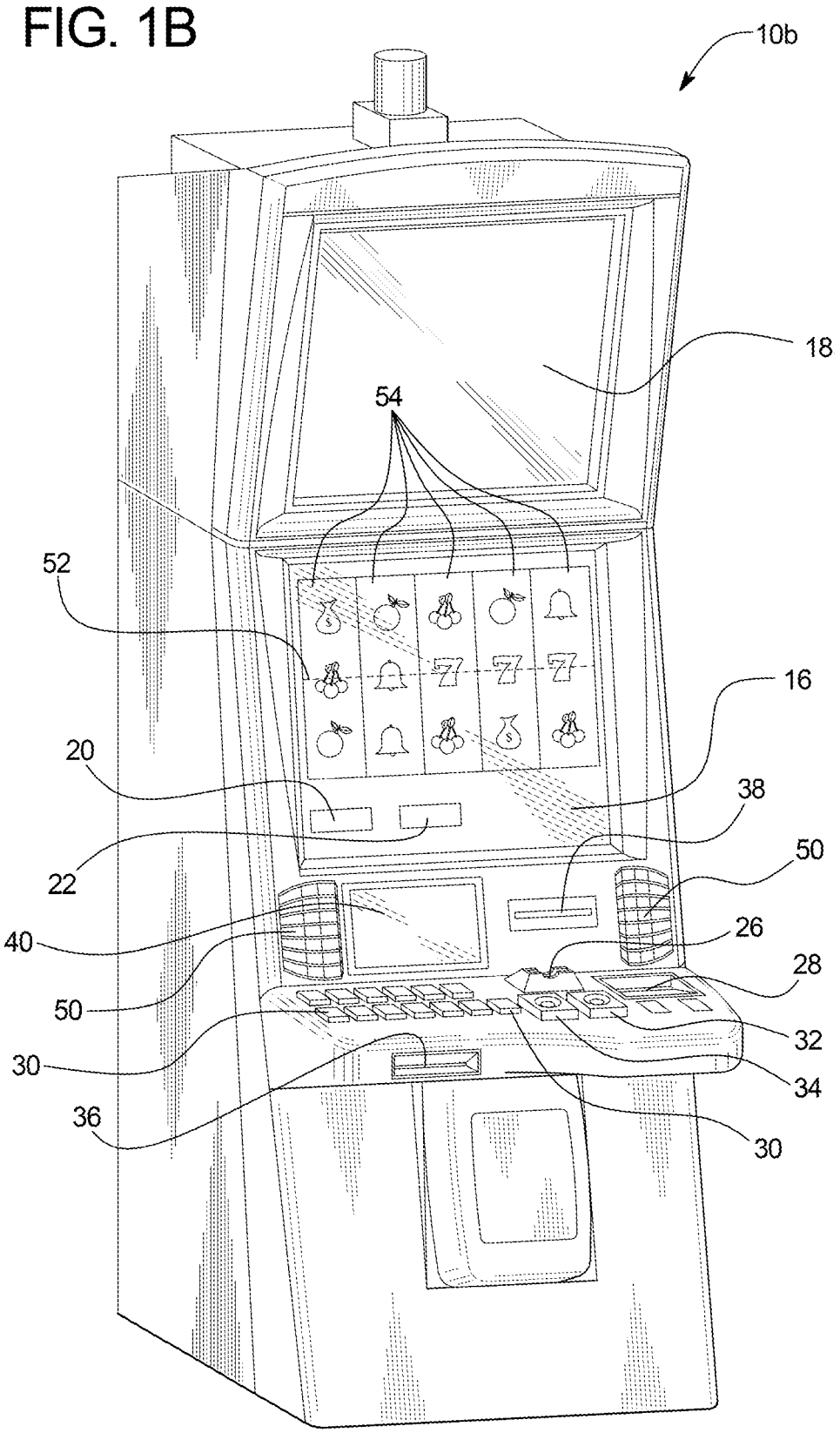
FIG. 1B is a front-side perspective view of another embodiment of the gaming device disclosed herein.

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 may have a support structure, housing, or cabinet which may provide support for a plurality of displays, inputs, controls, and other features of a conventional gaming machine. It is configured so that a player may operate it while standing or sitting. The gaming device may be positioned on a base or stand or may be configured as a pub-style table-top game (not shown) which a player may operate while sitting. As illustrated by the different configurations shown in FIGS. 1A and 1B, the gaming device may have varying cabinet and display configurations.

Figure 2A:
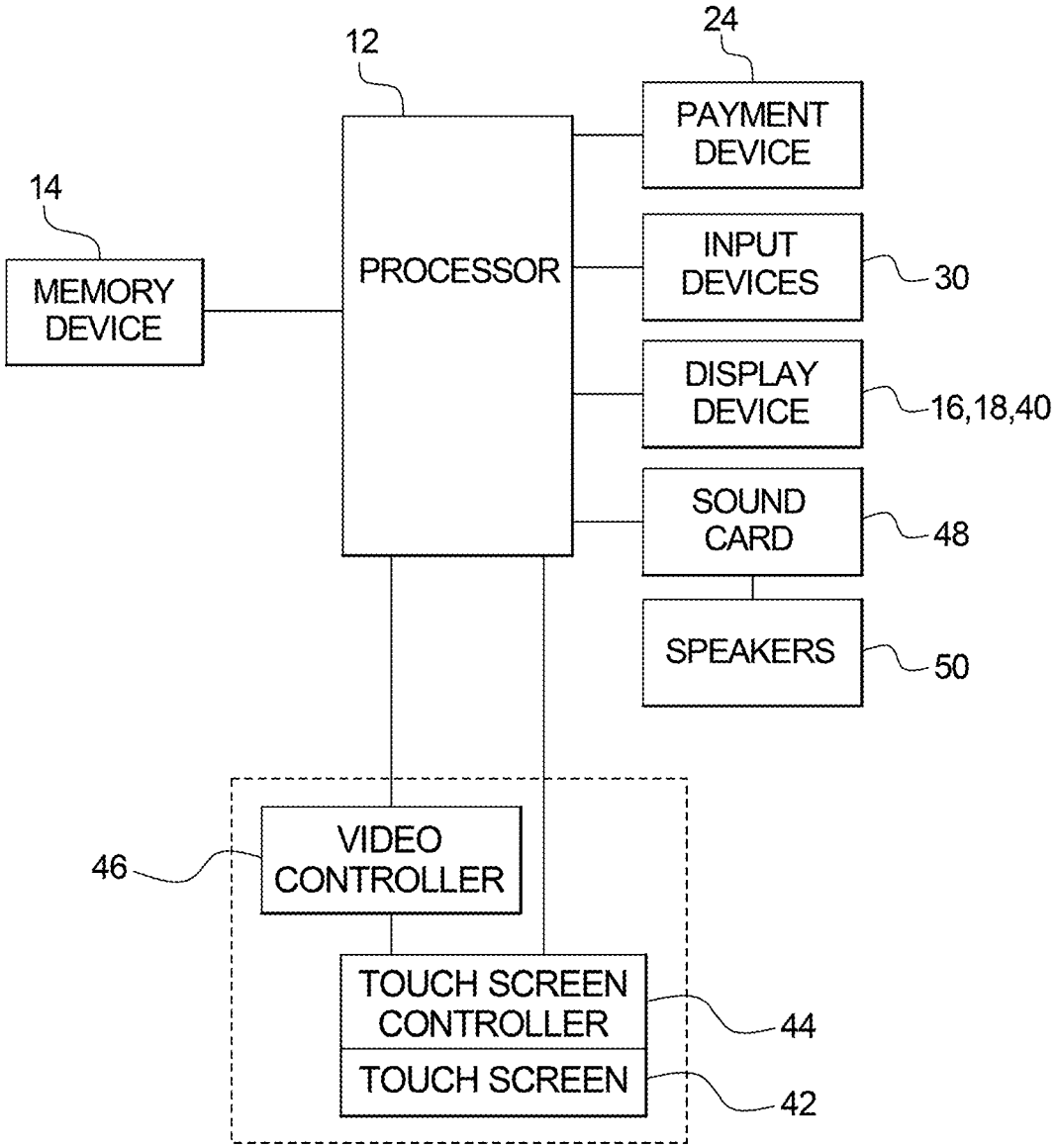
FIG. 2A is a schematic block diagram of the electronic configuration of one embodiment of the gaming device disclosed herein.

In one embodiment, as illustrated in FIG. 2A, the gaming device may include at least one processor 12, such as a microprocessor, a microcontroller-based platform, a suitable integrated circuit or one or more application-specific integrated circuits ("ASIC's"). The processor may be in communication with or operable to access or to exchange signals with at least one data storage or memory device 14. In one embodiment, the processor and the memory device reside within the cabinet of the gaming device. The memory device may store program code and instructions, executable by the processor, to control the gaming device. The memory device also may store other data such as image data, event data, player input data, random or pseudo-random number generators, pay-table data or information, and applicable game rules that relate to the play of the gaming device. In one embodiment, the memory device may include random access memory ("RAM"), which may include non-volatile RAM ("NVRAM"), magnetic RAM ("MRAM"), ferroelectric RAM ("FeRAM"), and other forms as commonly understood in the gaming industry. In one embodiment, the memory device may include read only memory ("ROM"). In one embodiment, the memory device may include flash memory and/or electrically erasable programmable read only memory ("EEPROM"). Any other suitable magnetic, optical, and/or semiconductor memory may operate in conjunction with the gaming device disclosed herein.

In one embodiment, part or all of the program code and/or operating data described above may be stored in a detachable or removable memory device, including, but not limited to, a suitable cartridge, disk, CD ROM, DVD, or USB memory device. In other embodiments, part or all of the program code and/or operating data described above may be downloaded to the memory device through a suitable network.

In one embodiment, an operator or a player may use such a removable memory device in a desktop computer, a laptop computer, a hand-held device, such as a personal digital assistant ("FDA"), a portable computing or mobile device, or another computerized platform to implement the present disclosure. In one embodiment, the gaming device or gaming machine disclosed herein may be operable over a wireless network, for example as part of a wireless gaming system. In one such embodiment, the gaming machine may be a hand-held device, a mobile device, or any other suitable wireless device that may enable a player to play any suitable game at a variety of different locations. In various embodiments in which the gaming device or gaming machine may be a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It may be appreciated that a gaming device or gaming machine as disclosed herein may be a device that may have obtained approval from a regulatory gaming commission or a device that may have not obtained approval from a regulatory gaming commission. It may be appreciated that the processor and memory device may be collectively referred to herein as a "computer" or "controller."

In one embodiment, as discussed in more detail below, the gaming device may randomly generate awards and/or other game outcomes based on probability data. In one such embodiment, this random determination may be provided through utilization of a random number generator ("RNG"), such as a true random number generator, a pseudo random number generator, or other suitable randomization process. In one embodiment, each award or other game outcome may be associated with a probability and the gaming device may generate the award or other game outcome to be provided to the player based on the associated probabilities. In this embodiment, since the gaming device may generate outcomes randomly or based upon one or more probability calculations, there is no certainty that the gaming device may ever provide the player with any specific award or other game outcome.

In another embodiment, as discussed in more detail below, the gaming device may employ a predetermined or finite set or pool of awards or other game outcomes. In this embodiment, as each award or other game outcome may be provided to the player, the gaming device may flag or remove the provided award or other game outcome from the predetermined set or pool. Once flagged or removed from the set or pool, the specific provided award or other game outcome from that specific pool cannot be provided to the player again. This type of gaming device may provide players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server may call the bingo balls that result in a specific bingo game outcome. The resultant game outcome may be communicated to the individual gaming device to be provided to a player. In one embodiment, this bingo outcome may be displayed to the player as a bingo game and/or in any form in accordance with the present disclosure.

In one embodiment, as illustrated in FIG. 2A, the gaming device may include one or more display devices controlled by the processor. The display devices may be connected to or mounted on the cabinet of the gaming device. The embodiment shown in FIG. 1A may include a central display device 16 which may display a primary game. This display device may also display any suitable secondary game associated with the primary game as well as information relating to the primary or secondary game. The alternative embodiment shown in FIG. 1B may include a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device may include a credit display 20 which may display a player's current number of credits, cash, account balance, or the equivalent. In one embodiment, the gaming device may include a bet display 22 which may display a player's amount wagered. In one embodiment, as described in more detail below, the gaming device may include a player tracking display 40 which may display information regarding a player's play tracking status.

In another embodiment, at least one display device may be a mobile display device, such as a PDA or tablet PC, that may enable play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device may include a touch-screen with an associated touch-screen controller. The display devices may be of any suitable size and configuration, such as a square, a rectangle or an elongated rectangle.

The display devices of the gaming device may be configured to display at least one or a plurality of game or other suitable images, symbols and indicia such as any visual representation or exhibition of the movement of objects such as mechanical, virtual, or video reels and wheels, dynamic lighting, video images, images of people, characters, may place, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device may include at least one payment device 24 in communication with the processor. As seen in FIGS. 1A and 1B, a payment device such as a payment acceptor may include a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card may be a smart card having a programmed microchip, a coded magnetic strip or coded rewritable magnetic strip, wherein the programmed microchip or magnetic strips may be coded with a player's identification, credit totals (or related data), and/or other relevant information. In another embodiment, a player may carry a portable device, such as a cell phone, a radio frequency identification tag, or any other suitable wireless device, which may communicate a player's identification, credit totals (or related data), and other relevant information to the gaming device. In one embodiment, money may be transferred to a gaming device through electronic funds transfer. When a player funds the gaming device, the processor may determine the amount of funds entered and may display the corresponding amount on the credit or other suitable display as described above.

As seen in FIGS. 1A, 1B, and 2A, in one embodiment the gaming device may include at least one or a plurality of input devices 30 in communication with the processor. The input devices may include any suitable device which may enable the player to produce an input signal which may be received by the processor. In one embodiment, after appropriate funding of the gaming device, the input device may be a game activation device, such as a play button 32 or a pull arm (not shown) which may be used by the player to start any primary game or sequence of events in the gaming device. The play button may be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device may be a bet one button. The player may place a bet by pushing the bet one button. The player may increase the bet by one credit each time the player pushes the bet one button. When the player pushes the bet one button, the number of credits shown in the credit display may decrease by one, and the number of credits shown in the bet display may increase by one. In another embodiment, one input device may be a bet max button (not shown) which may enable the player to bet the maximum wager permitted for a game of the gaming device.

In one embodiment, one input device may be a cash out button 34. The player may push the cash out button to receive a cash payment or other suitable form of payment corresponding to the number of remaining credits. In one embodiment, when the player cashes out, a payment device, such as a ticket, payment, or note generator 36 prints or otherwise may generate a ticket or credit slip to provide to the player. The player may receive the ticket or credit slip and may redeem the value associated with the ticket or credit slip via a cashier (or other suitable redemption system). In another embodiment, when the player cashes out, the player may receive the coins or tokens in a coin payout tray. It may be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device may be a touch-screen 42 coupled with a touch-screen controller 44 or some other touch-sensitive display overlay to allow for player interaction with the images on the display. The touch-screen and the touch-screen controller may be connected to a video controller 46. A player may make decisions and input signals into the gaming device by touching the touch-screen at the appropriate locations. One such input device may be a conventional touch-screen button panel.

The gaming device may further may include a plurality of communication ports for enabling communication of the processor with external peripherals, such as external video sources, expansion buses, game or other displays, a SCSI port, or a keypad.

In one embodiment, as seen in FIG. 2A, the gaming device may include a sound generating device controlled by one or more sounds cards 48 which function in conjunction with the processor. In one embodiment, the sound generating device may include at least one or a plurality of speakers 50 or other sound generating hardware and/or software for generating sounds, such as by playing music for the primary and/or secondary game or by playing music for other modes of the gaming device, such as an attract mode. In one embodiment, the gaming device may provide dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that may be selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

In one embodiment, the gaming device 10 may incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment may produce a random outcome based on probability data at the time of or after placement of a wager. That is, different primary wagering games, such as video poker games, video blackjack games, video keno, video bingo or any other suitable primary or base game may be implemented. In one embodiment, the disclosed multi-dimensional cascading symbol game may be implemented as a base or primary game.

In one embodiment, as illustrated in FIGS. 1A and 1B, a base or primary game may be a slot game with one or more paylines 52. In this embodiment, the gaming device may include at least one or a plurality of reels 54, such as three to five reels 54, in either electromechanical form with mechanical rotating reels or video form with simulated reels and movement thereof. In one embodiment, an electromechanical slot machine may include a plurality of adjacent, rotatable reels which may be combined and operably coupled with an electronic display of any suitable type. In another embodiment, if the reels 54 are in video form, one or more of the display devices, as described above, may display the plurality of simulated video reels 54. Each reel 54 may display a plurality of indicia or symbols, such as bells, hearts, fruits, numbers, letters, bars, or other images which may correspond to a theme associated with the gaming device. In another embodiment, one or more of the reels may be independent reels or unisymbol reels. In this embodiment, each independent or unisymbol reel may generate and may display one symbol to the player.

In one embodiment, one or more of the paylines may be horizontal, vertical, circular, diagonal, angled or any combination thereof. In another embodiment, one or more of the paylines each may include a plurality of adjacent symbol display positions on a requisite number of adjacent reels. In one such embodiment, one or more paylines may be formed between at least two symbol display positions which may be adjacent to each other by either sharing a common side or sharing a common corner (i.e., such paylines may be connected paylines). In these embodiments, the gaming device may enable a player to wager on one or more of such paylines to activate such wagered on paylines.

In another embodiment wherein one or more paylines may be formed between at least two symbol display positions which may be adjacent to each other, the gaming device may enable a player to wager on and thus activate a plurality of symbol display positions. In this embodiment, one or more paylines which may be formed from a plurality of adjacent active symbol display positions on a requisite number of adjacent reels may be activated.

In one embodiment, the gaming device may award prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device may determine any outcome to provide to the player based on the number of associated symbols which may be generated in active symbol display positions on the requisite number of adjacent reels (i.e., not on paylines passing through any displayed winning symbol combinations). In this embodiment, if a winning symbol combination is generated on the reels, the gaming device may provide the player one award for that occurrence of the generated winning symbol combination. For example, if one winning symbol combination is generated on the reels, the gaming device may provide a single award to the player for that winning symbol combination (i.e., not based on the number of paylines that would have passed through that winning symbol combination). It may be appreciated that a gaming device that may enable wagering on ways to win may provide the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win may be determined by multiplying the number of symbols generated in active symbol display positions on a first reel by the number of symbols generated in active symbol display positions on a second reel by the number of symbols generated in active symbol display positions on a third reel and so on for each reel of the gaming device with at least one symbol generated in an active symbol display position. For example, a three reel gaming device with three symbols generated in active symbol display positions on each reel includes 27 ways to win (i.e., 3 symbols on the first reel×3 symbols on the second reel×3 symbols on the third reel). A four reel gaming device with three symbols generated in active symbol display positions on each reel includes 81 ways to win (i.e., 3 symbols on the first reel×3 symbols on the second reel×3 symbols on the third reel×3 symbols on the fourth reel). A five reel gaming device with three symbols generated in active symbol display positions on each reel includes 243 ways to win (i.e., 3 symbols on the first reel×3 symbols on the second reel×3 symbols on the third reel×3 symbols on the fourth reel×3 symbols on the fifth reel). It may be appreciated that modifying the number of generated symbols by either modifying the number of reels or modifying the number of symbols generated in active symbol display positions by one or more of the reels modifies the number of ways to win.

In another embodiment, the gaming device may enable a player to wager on and thus activate symbol display positions. In one such embodiment, the symbol display positions may be on the reels. In this embodiment, if based on the player's wager, a reel is activated, then each of the symbol display positions of that reel may be activated and each of the active symbol display positions may be part of one or more of the ways to win. In one embodiment, if based on the player's wager, a reel is not activated, then a designated number of default symbol display positions, such as a single symbol display position of the middle row of the reel, may be activated and the default symbol display position(s) may be part of one or more of the ways to win. This type of gaming machine may enable a player to wager on one, more than one or all of the reels and the processor of the gaming device uses the number of wagered on reels to determine the active symbol display positions and the number of possible ways to win. In alternative embodiments, (1) no symbols may be displayed as generated at any of the inactive symbol display positions, or (2) any symbols generated at any inactive symbol display positions may be displayed to the player but suitably shaded or otherwise designated as inactive.

In one embodiment wherein a player wagers on one or more reels, a player's wager of one credit may activate each of the three symbol display positions on a first reel, wherein one default symbol display position may be activated on each of the remaining four reels. In this example, as described above, the gaming device may provide the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol display positions on a first reel, each of the three symbol display positions on a second reel and each of the three symbol display positions on a third reel wherein one default symbol display position may be activated on each of the remaining two reels. In this example, as described above, the gaming device may provide the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually may determine if a symbol generated in an active symbol display position on a first reel may form part of a winning symbol combination with or is otherwise suitably related to a symbol generated in an active symbol display position on a second reel. In this embodiment, the gaming device classifies each pair of symbols which form part of a winning symbol combination (i.e., each pair of related symbols) as a string of related symbols. For example, if active symbol display positions may include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device may determine if any of the symbols from the next adjacent reel may be added to any of the formed strings of related symbols. In this embodiment, for a first of the classified strings of related symbols, the gaming device may determine if any of the symbols generated by the next adjacent reel form part of a winning symbol combination or are otherwise related to the symbols of the first string of related symbols. If the gaming device determines that a symbol generated on the next adjacent reel may be related to the symbols of the first string of related symbols, that symbol may be subsequently added to the first string of related symbols. For example, if the first string of related symbols is the string of related cherry symbols and a related cherry symbol is generated in the middle row of the third reel, the gaming device may add the related cherry symbol generated on the third reel to the previously classified string of cherry symbols.

On the other hand, if the gaming device determines that no symbols generated on the next adjacent reel are related to the symbols of the first string of related symbols, the gaming device may mark or flag such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device may proceed as described above for each of the remaining classified strings of related symbols which were previously classified or formed from related symbols on the first and second reels.

After analyzing each of the remaining strings of related symbols, the gaming device may determine, for each remaining pending or incomplete string of related symbols, if any of the symbols from the next adjacent reel, if any, may be added to any of the previously classified strings of related symbols. This process may continue until either each string of related symbols is complete or there are no more adjacent reels of symbols to analyze. In this embodiment, where there are no more adjacent reels of symbols to analyze, the gaming device may mark each of the remaining pending strings of related symbols as complete.

When each of the strings of related symbols is marked complete, the gaming device compares each of the strings of related symbols to an appropriate paytable and may provide the player any award associated with each of the completed strings of symbols. It may be appreciated that the player may be provided one award, if any, for each string of related symbols generated in active symbol display positions (i.e., as opposed to a quantity of awards being based on how many paylines that would have passed through each of the strings of related symbols in active symbol display positions).

In one embodiment, a base or primary game may be a poker game wherein the gaming device may enable the player to play a conventional game of video draw poker and may initially deal five cards all face up from a virtual deck of fifty-two cards. Cards may be dealt as in a traditional game of cards or in the case of the gaming device, the cards may be randomly selected from a predetermined number of cards. If the player wishes to draw, the player may select the cards to hold via one or more input devices, such as by pressing related hold buttons or via the touch screen. The player then presses the deal button and the unwanted or discarded cards may be removed from the display and the gaming machine may deal the replacement cards from the remaining cards in the deck. This may result in a final five-card hand. The gaming device may compare the final five-card hand to a payout table which may utilize conventional poker hand rankings to determine the winning hands. The gaming device may provide the player with an award based on a winning hand and the number of credits the player wagered.

In another embodiment, the base or primary game may be a multi-hand version of video poker. In this embodiment, the gaming device may deal the player at least two hands of cards. In one such embodiment, the cards may be the same cards. In one embodiment each hand of cards may be associated with its own deck of cards. The player may choose the cards to hold in a primary hand. The held cards in the primary hand may be also held in the other hands of cards. The remaining non-held cards may be removed from each hand displayed and for each hand replacement cards may be randomly dealt into that hand. Since the replacement cards may be randomly dealt independently for each hand, the replacement cards for each hand may be different. The poker hand rankings may be then determined hand by hand against a payout table and awards may be provided to the player.

In one embodiment, a base or primary game may be a keno game wherein the gaming device may display a plurality of selectable indicia or numbers on at least one of the display devices. In this embodiment, the player may select at least one bit potentially a plurality of the selectable indicia or numbers via an input device such as a touch screen. The gaming device then may display a series of drawn numbers and determine an amount of matches, if any, between the player's selected numbers and the gaming device's drawn numbers. The player may be provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. In one embodiment, the disclosed multi-dimensional cascading symbol game may be implemented as a bonus or secondary game. The bonus or secondary game may enable the player to obtain a prize or payout in addition to the prize or payout, if any, obtained from the base or primary game. In general, a bonus or secondary game may produce a significantly higher level of player excitement than the base or primary game because it may provide a greater expectation of winning than the base or primary game, and may be accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may occur based on exceeding a certain amount of game play (such as number of games, number of credits, amount of time), or reaching a specified number of points earned during game play.

In one embodiment, the gaming device processor 12 or central controller 56 randomly may provide the player one or more plays of one or more secondary games. In one such embodiment, the gaming device may not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device may include a program which may automatically begin a bonus round after the player may have achieved a triggering event or qualifying condition in the base or primary game. In another embodiment, after a player may have qualified for a bonus game, the player may subsequently enhance his/her bonus game participation through continued play on the base or primary game. Thus, for each bonus qualifying event, such as a bonus symbol, that the player may obtain, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game may be needed. That is, a player may not purchase entry into a bonus game; rather they must win or earn entry through play of the primary game, thus encouraging play of the primary game. In another embodiment, qualification of the bonus or secondary game may be accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
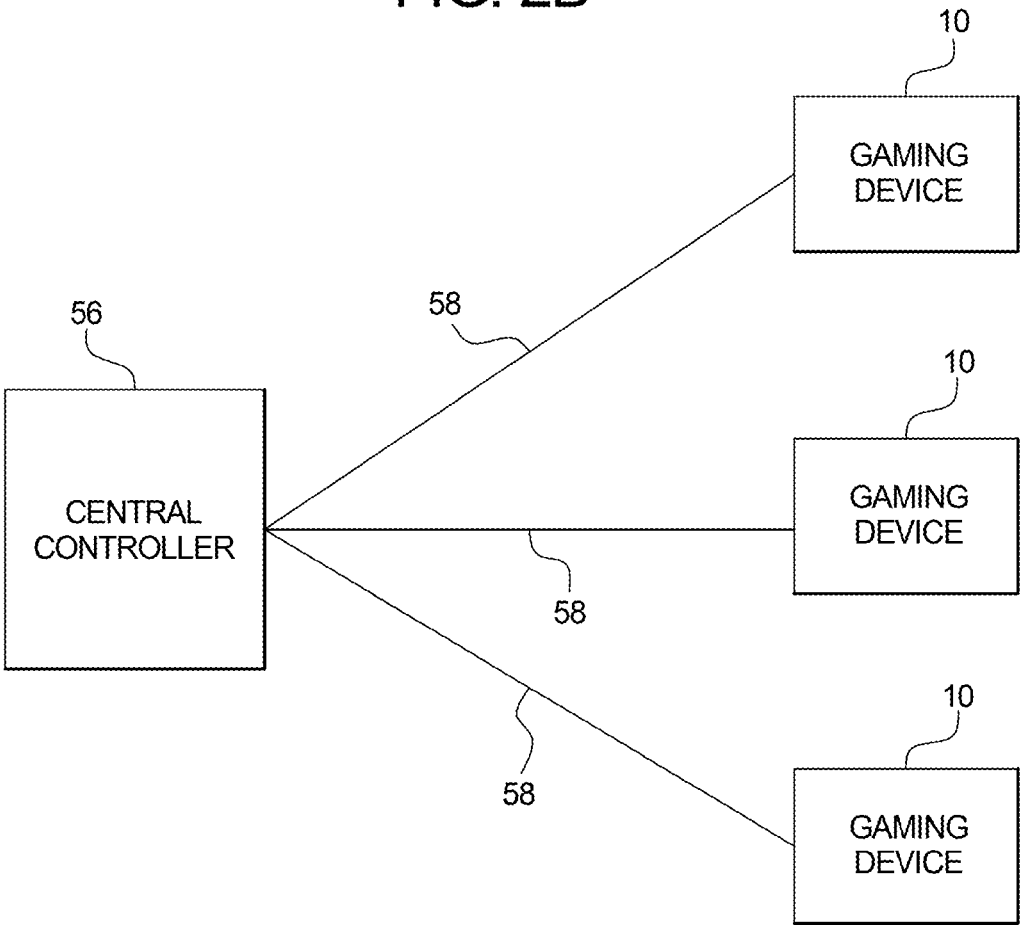
FIG. 2B is a schematic block diagram illustrating a plurality of gaming devices in communication with a central controller.

In one embodiment, as illustrated in FIG. 2B, one or more of the gaming devices 10 may be in communication with each other and/or at least one central controller 56 through a data network or remote communication link 58. In this embodiment, the central server, central controller or remote host may be any suitable server or computing device which may include at least one processor and at least one memory or storage device. In different such embodiments, the central server may be a progressive controller or a processor of one of the gaming devices in the gaming system. In these embodiments, the processor of each gaming device may be designed to transmit and receive events, messages, commands, or any other suitable data or signal between the individual gaming device and the central server. The gaming device processor may be operable to execute such communicated events, messages, or commands in conjunction with the operation of the gaming device. Moreover, the processor of the central server may be designed to transmit and receive events, messages, commands, or any other suitable data or signal between the central server and each of the individual gaming devices. The central server processor may be operable to execute such communicated events, messages, or commands in conjunction with the operation of the central server. It may be appreciated that one, more or each of the functions of the central controller, central server or remote host as disclosed herein may be performed by one or more gaming device processors. It may be further appreciated that one, more or each of the functions of one or more gaming device processors as disclosed herein may be performed by the central controller, central server or remote host.

In one embodiment, the game outcome provided to the player may be determined by a central server or controller and provided to the player at the gaming device. In this embodiment, each of a plurality of such gaming devices may be in communication with the central server or controller. Upon a player initiating game play at one of the gaming devices, the initiated gaming device may communicate a game outcome request to the central server or controller.

In one embodiment, the central server or controller may receive the game outcome request and may randomly generate a game outcome for the primary game based on probability data. In another embodiment, the central server or controller may randomly generate a game outcome for the secondary game based on probability data. In another embodiment, the central server or controller may randomly generate a game outcome for both the primary game and the secondary game based on probability data. In this embodiment, the central server or controller may be capable of storing and utilizing program code or other data similar to the processor and memory device of the gaming device.

In an alternative embodiment, the central server or controller maintains one or more predetermined pools or sets of predetermined game outcomes. In this embodiment, the central server or controller may receive the game outcome request and independently select a predetermined game outcome from a set or pool of game outcomes. The central server or controller may flag or mark the selected game outcome as used. Once a game outcome is flagged as used, it may be prevented from further selection from the set or pool and cannot be selected by the central controller or server upon another wager. The provided game outcome may include a primary game outcome, a secondary game outcome, primary and secondary game outcomes, or a series of game outcomes such as free games.

The central server or controller may communicate the generated or selected game outcome to the initiated gaming device. The gaming device may receive the generated or selected game outcome and may provide the game outcome to the player. In an alternative embodiment, how the generated or selected game outcome is to be presented or displayed to the player, such as a reel symbol combination of a slot machine or a hand of cards dealt in a card game, may also be determined by the central server or controller and communicated to the initiated gaming device to be presented or displayed to the player. Central production or control may assist a gaming establishment or other entity in maintaining appropriate records, controlling gaming, reducing and preventing cheating or electronic or other errors, reducing or eliminating win-loss volatility, and the like.

In another embodiment, a predetermined game outcome value may be determined for each of a plurality of linked or networked gaming devices based on the results of a bingo, keno, or lottery game. In this embodiment, each individual gaming device may utilize one or more bingo, keno, or lottery games to determine the predetermined game outcome value provided to the player for the interactive game played at that gaming device. In one embodiment, the bingo, keno, or lottery game may be displayed to the player. In another embodiment, the bingo, keno or lottery game may not be displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device may be provided or associated with a different bingo card. Each bingo card may consist of a matrix or array of elements, wherein each element may be designated with a separate indicia, such as a number. It may be appreciated that each different bingo card may include a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller may randomly select or draw, one at a time, a plurality of the elements. As each element is selected, a determination may be made for each gaming device as to whether the selected element is present on the bingo card provided to that enrolled gaming device. This determination may be made by the central controller, the gaming device, a combination of the two, or in any other suitable manner. If the selected element is present on the bingo card provided to that enrolled gaming device, that selected element on the provided bingo card may be marked or flagged. This process of selecting elements and marking any selected elements on the provided bingo cards may continue until one or more predetermined patterns are marked on one or more of the provided bingo cards. It may be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome may be determined for each of the enrolled gaming devices based, at least in part, on the selected elements on the provided bingo cards. As described above, the game outcome determined for each gaming device enrolled in the bingo game may be utilized by that gaming device to determine the predetermined game outcome provided to the player. For example, a first gaming device to have selected elements marked in a predetermined pattern may be provided a first outcome of win $10 which may be provided to a first player regardless of how the first player plays in a first game, and a second gaming device to have selected elements marked in a different predetermined pattern may be provided a second outcome of win $2 which may be provided to a second player regardless of how the second player plays a second game. It may be appreciated that as the process of marking selected elements may continue until one or more predetermined patterns are marked, this embodiment ensures that at least one bingo card may win the bingo game and thus at least one enrolled gaming device may provide a predetermined winning game outcome to a player. It may be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern may be provided to the player as part of the predetermined game outcome. For example, if the four corners of a bingo card are marked within the first twenty selected elements, a supplemental award of $10 may be provided to the player as part of the predetermined game outcome. It may be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices may be in communication with a central server or controller for monitoring purposes only. That is, each individual gaming device may randomly generate the game outcomes to be provided to the player and the central server or controller monitors the activities and events occurring on the plurality of gaming devices. In one embodiment, the gaming network may include a real-time or on-line accounting and gaming information system operably coupled to the central server or controller. The accounting and gaming information system of this embodiment may include a player database for storing player profiles, a player tracking module for tracking players and a credit system for providing automated casino transactions.

In one embodiment, the gaming device disclosed herein may be associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system may track any player's gaming activity at the gaming device. In one such embodiment, the gaming device may include at least one card reader 38 in communication with the processor. In this embodiment, a player may be issued a player identification card which may have an encoded player identification number that uniquely identifies the player. When a player inserts their playing tracking card into the card reader to begin a gaming session, the card reader reads the player identification number off the player tracking card to identify the player. The gaming device and/or associated player tracking system may timely track any suitable information or data relating to the identified player's gaming session. Directly or via the central controller, the gaming device processor may communicate such information to the player tracking system. The gaming device and/or associated player tracking system also may timely track when a player removes their player tracking card when concluding play for that gaming session. In another embodiment, rather than requiring a player to insert a player tracking card, the gaming device may utilize one or more portable devices carried by a player, such as a cell phone, a radio frequency identification tag or any other suitable wireless device to track when a player begins and ends a gaming session. In another embodiment, the gaming device may utilize any suitable biometric technology or ticket technology to track when a player begins and ends a gaming session.

During one or more gaming sessions, the gaming device and/or player tracking system may track any suitable information or data, such as any amounts wagered, average wager amounts, and/or the time at which these wagers may be placed. In different embodiments, for one or more players, the player tracking system may include the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system may be displayed on a player tracking display 40. In another embodiment, such tracked information and/or any suitable feature associated with the player tracking system may be displayed via one or more service windows (not shown) which may be displayed on the central display device and/or the upper display device.

In one embodiment, a plurality of the gaming devices may be capable of being connected together through a data network. In one embodiment, the data network may be a local area network (LAN), in which one or more of the gaming devices may be substantially proximate to each other and an on-site central server or controller as in, for example, a gaming establishment or a portion of a gaming establishment. In another embodiment, the data network may be a wide area network (WAN) in which one or more of the gaming devices may be in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network may be an internet or intranet. In this embodiment, the operation of the gaming device may be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator may be available. The expansion in the number of computers and number and speed of internet connections in recent years increases opportunities for players to play from an ever-increasing number of remote sites. It may be appreciated that the enhanced bandwidth of digital wireless communications may render such technology suitable for some or all communications, particularly if such communications may be encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices may be in communication with a central server or controller. The central server or controller may be any suitable server or computing device which may include at least one processor and a memory or storage device. In alternative embodiments, the central server may be a progressive controller or another gaming machine in the gaming system. In one embodiment, the memory device of the central server may store different game programs and instructions, executable by a gaming device processor, to control the gaming device. Each executable game program may represent a different game or type of game which may be played on one or more of the gaming devices in the gaming system. Such different games may include the same or substantially the same game play with different pay tables. In different embodiments, the executable game program may be for a primary game, a secondary game or both. In another embodiment, the game program may be executable as a secondary game to be played simultaneous with the play of a primary game (which may be downloaded to or fixed on the gaming device) or vice versa.

In this embodiment, each gaming device may include at least one or more display devices and/or one or more input devices for interaction with a player. A local processor, such as the above-described gaming device processor or a processor of a local server, may be operable with the display device(s) and/or the input device(s) of one or more of the gaming devices.

In operation, the central controller may be operable to communicate one or more of the stored game programs to at least one local processor. In different embodiments, the stored game programs may be communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs may be communicated from the central server, the local processor may execute the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer may be coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer may be maintained for the overall operation and control of the progressive gaming system. In this embodiment, a progressive gaming system host site computer may oversee the entire progressive gaming system and may be the master for computing all progressive jackpots. All participating gaming sites report to, and receive information from, the progressive gaming system host site computer. Each central server computer may be responsible for all data communication between the gaming device hardware and software and the progressive gaming system host site computer. In one embodiment, an individual gaming machine may trigger a progressive award win. In another embodiment, a central server (or the progressive gaming system host site computer) may determine when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win may be triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device may be randomly or apparently randomly selected to provide a player of that gaming device one or more progressive awards. In one such embodiment, the gaming device may not provide any apparent reasons to the player for winning a progressive award, wherein winning the progressive award is not triggered by an event in or based specifically on any of the plays of any primary game. That is, a player may be provided a progressive award without any explanation or alternatively with simple explanations. In another embodiment, a player may be provided a progressive award at least partially based on a game triggered or symbol triggered event, such as at least partially based on the play of a primary game.

In one embodiment, one or more of the progressive awards may be each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player may place or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player may win one of the progressive awards. It may be appreciated that one or more of the progressive awards may each be funded, at least in part, based on the wagers placed on the primary games of the gaming machines in the gaming system, via a gaming establishment or via any suitable manner.

In another embodiment, one or more of the progressive awards may be partially funded via a side-bet or side-wager which the player may make (and which may be tracked via a side-bet meter). In one embodiment, one or more of the progressive awards may be funded with only side-bets or side-wagers placed. In another embodiment, one or more of the progressive awards may be funded based on player's wagers as described above as well as any side-bets or side-wagers placed.

In one alternative embodiment, a minimum wager level may be required for a gaming device to qualify to be selected to obtain one of the progressive awards. In one embodiment, this minimum wager level may be the maximum wager level for the primary game in the gaming machine. In another embodiment, no minimum wager level may be required for a gaming machine to qualify to be selected to obtain one of the progressive awards.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group may be shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Mobile Device Utilization

Figure 3:
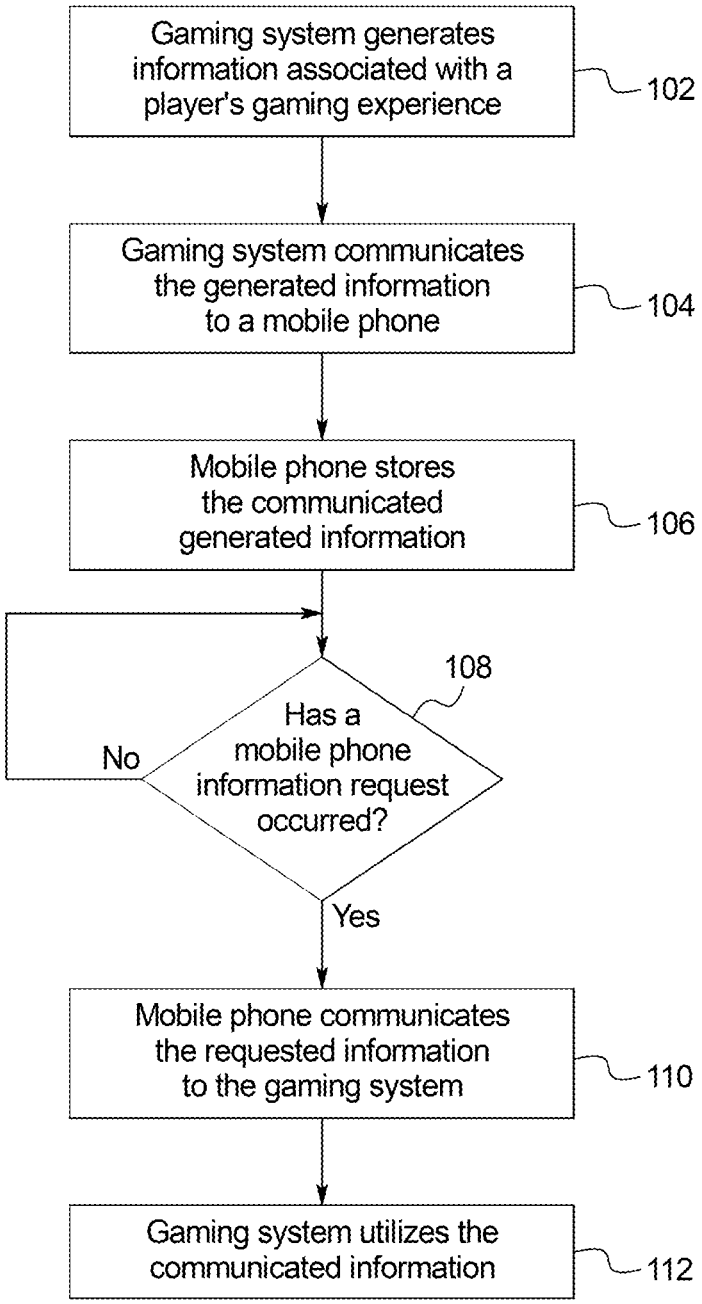
FIG. 3 is a flowchart of one embodiment of the gaming system disclosed herein illustrating the utilization of a mobile phone in association with a player's gaming experience.

Referring now to FIG. 3, a flowchart of an example embodiment of a process for operating a gaming system, a gaming server or a gaming device disclosed herein is illustrated. In one embodiment, this process may be embodied in one or more software programs stored in one or more memories and executed by one or more processors or one or more servers. Although this process may be described with reference to the flowchart illustrated in FIG. 3, it may be appreciated that many other methods of performing the acts associated with this process may be used. For example, the order of certain steps described may be changed, or certain steps described may be optional.

In various embodiments, the gaming system may generate data or information associated with a player's gaming experience as indicated in block 102. In one embodiment, the gaming system may generate data or information based on a displayed event associated with a play of a primary game and/or a play of a secondary game. In another embodiment, the gaming system may generate data or information based on an event independent of any displayed event associated with any play of a primary game and/or any play of a secondary game.

In one embodiment, the generated data may be associated with data obtained from one or more components of the gaming system, such as data obtained from a player tracking system. In another embodiment, the generated data may be associated with data obtained from an application running in one or more service windows of a gaming device, such as the service windows described in U.S. Published Patent Application No. 2007/0243934, U.S. Published Patent Application No. 2007/0243928, U.S. Published Patent Application No. 2008/0009344, U.S. Published Patent Application No. 2009/0104954, and/or U.S. Published Patent Application No. 2009/0233705.

In another embodiment, the generated data may be associated with one or more player preferences. In another embodiment, the generated data may be associated with one or more characteristics or virtual goods associated with the player. In another embodiment, the generated data may be associated with one or more redeemable units which a player may redeem to access a game. In another embodiment, the generated data may be associated with one or more types of currency which the player may utilize to initiate a play of a game and/or obtain another benefit. In another embodiment, the generated data may be associated with any game event or game component of any type of game. In another embodiment, the generated data may be associated with a player's status or progress for one or more different games or types of games. In one such embodiment, a persistence game includes one or more stages or levels, wherein each stage or level is associated with different content, such as one or more different games to play. In this embodiment, zero, one or more stages or levels are initially locked and zero, one or more stages or levels are initially unlocked wherein the game(s) of an unlocked stage or level are available for the player to play while the game(s) of a locked stage or level are unavailable for the player to play. In this embodiment, as the player plays the persistence game, the player unlocks different stages or levels to access the content of such stages or levels and the generated data is associated with the player's status in the persistence game (e.g., which stages or levels are locked and which stage or levels are unlocked).

After generating data or information associated with a player's gaming experience, the gaming system may communicate the generated data or information to a mobile phone, such as a smart phone, as indicated in block 104. Specifically, one or more processors of the gaming system, such as one or more central servers, may cause the generated data or information to be communicated to a player's mobile phone.

In one embodiment, the gaming system may communicate the generated data to a mobile phone (and/or the mobile phone may communicate data to the gaming system) via one or more messaging services, such as via text messaging, via multimedia messaging, or via e-mail. In another embodiment, the gaming system may wireless communicate the generated data to a mobile phone (and/or the mobile phone may communicate data to the gaming system), such as via a Bluetooth connection, an infrared connection or a near field communication connection. In another embodiment, the gaming system may communicate the generated data to a mobile phone (and/or the mobile phone may communicate data to the gaming system) via one or more data networks, such as via the Internet. In this embodiment, the gaming system may utilize one or more applications, such as a Java applet, run by the gaming system and/or the mobile phone to transfer any data between the gaming system and the mobile phone. In another embodiment, the gaming system may communicate the generated data to a mobile phone (and/or the mobile phone may communicate data to the gaming system) by displaying certain information, such as one or more barcodes. In one such embodiment, the player may utilize their mobile phone to scan the displayed information, such as scanning or photographing any displayed barcodes, to retrieve the generated data (or to direct the mobile phone to communicate with one or more processors to retrieve the generated data). In another such embodiment, the player may input the displayed information into their mobile phone to retrieve the generated data (or to direct the mobile phone to communicate with one or more processors to retrieve the generated data).

Following the communication of the generated data, the mobile phone may then store the communicated generated data or information as indicated in block 106. It may be appreciated that rather than having the data generated by the gaming system in association with a player's gaming experience tied to one or more individual memory devices of a gaming system (as in available gaming systems), storing the data on one or more memory devices of a player's mobile phone lightens the computational load on the processor(s) of the gaming system. Such a configuration frees up the processing power of the gaming system to execute other features which enhance the player's gaming experience.

After storing the generated data, the mobile phone may determine whether a mobile phone information request has occurred as indicated in diamond 108. In one embodiment, the mobile phone information request may occur based on a displayed event associated with a play of a primary game and/or a play of a secondary game. In another embodiment, the mobile phone information request may occur based on an event independent of any displayed event associated with any play of a primary game and/or any play of a secondary game. In another embodiment, the mobile phone information request may occur when a player makes one or more inputs on the mobile phone to access the stored data or information.

If the gaming system determines that no mobile phone information request occurred, the gaming system may return to block 108 and continue to monitor for any occurrence of a mobile phone information request.

On the other hand, if the gaming system determines that a mobile phone information request occurred, the mobile phone may communicate the requested information to the gaming system as indicated in block 110. In one such embodiment, one or more processors of the mobile phone may cause the stored data or information to be communicated to the gaming system via one or more messaging services, via one or more wireless communication services, and/or via one or more data networks. In another such embodiment, one or more processors of the mobile phone may cause the stored data or information to be displayed as a barcode by a display device of the mobile phone. In this embodiment, the gaming device is connected to a scanner which scans the barcode to retrieve the stored data or information (or which directs the gaming system to communicate with one or more processors to retrieve the stored data or information). In another such embodiment, one or more processors of the mobile phone may cause the stored data or information to be displayed by a display device of the mobile phone to facilitate a player to manually enter the data or information to the gaming system (or to facilitate the player to manually enter data which directs the gaming system to communicate with one or more processors to retrieve the stored data or information).

Following the communication of the requested information, the gaming system may utilize the communicated data or information as indicated in block 112. In one embodiment, the gaming system utilizes the communicated data or information in association with a displayed event associated with a play of a primary game and/or a play of a secondary game. In another embodiment, the gaming system utilizes the communicated data or information in association with an event independent of any displayed event associated with any play of a primary game and/or any play of a secondary game.

In one embodiment (not shown), the gaming system may additionally monitor for a mobile phone communication termination event to occur. In this embodiment, when a mobile phone communication termination event occurs, the gaming system may disable the communication between the mobile phone and the gaming system. In one such embodiment, upon disabling the communication between the mobile phone and the gaming system, the gaming system may send one or more summary messages to the mobile phone which the mobile phone may utilize to display to the player a summary of their gaming experience. In different embodiments, the mobile phone communication termination event occurs: when the gaming system determines that the player has walked away from a played gaming device (e.g., the gaming system determines that a wireless communication signal between the mobile phone and the gaming system has been lost or is outside of a designated range); when the gaming system determines that a gaming device has been idle or unplayed for a designated period of time; when the gaming system determines that the player has exited or closed an application running on a gaming device and/or running on the mobile phone; and/or when the gaming system determines that the line of communication with the mobile phone has been severed.

In one embodiment, as mentioned above, the data communicated to/from the player's mobile phone may be associated with any game event or game component of any type of game. In different embodiments, the game in which the data is associated with may include, but may not be limited to: any suitable slot game, any suitable free spins or free activations game, any suitable wheel game, any suitable card game, any suitable keno game, any suitable bingo game, any suitable die or dice game, any suitable virtual horse racing game; any suitable offer and acceptance game, any suitable award ladder game, any suitable puzzle-type game, any suitable persistence game, any suitable selection game, any suitable cascading symbols game, any suitable ways to win game, any suitable scatter pay game, any suitable elimination game, any suitable group or community cooperation game, any suitable group or community competition game, any game or type of game described herein or any other suitable type of game. In different embodiments, the game event or game component which the data is associated with may include, but may not be limited to: a quantity of free spins, a quantity of free activations of one or more games, an applicable multiplier for at least one, a plurality or each of the free spins, a starting credit amount (based on a triggering event and/or a wager placed), a quantity of picks in a game, a quantity of selections in a game, a quantity of wild symbols in a game, a quantity of retrigger symbols in a game, a quantity of terminators or termination symbols in a game, a quantity of anti-terminators in a game, a quantity of locking reels in a game, a quantity of locking symbol positions in a game, a quantity of expanding symbols in a game, a quantity of rounds or levels in a game, a quantity of award opportunities in a game, a quantity of progressive awards in a game, a range of available awards in a game, a maximum award in a game, a minimum award in a game, an average expected award in a game, a quantity of active reels in a game, a quantity of active paylines in a game, a quantity of offers in a game, a paytable will be utilized in a game, a quantity of hands of playing cards in a game, any game component disclosed herein, and any other suitable game component.

In one embodiment, as mentioned above, the data communicated to/from the player's mobile phone may be associated with one or more types of monetary currency and/or virtual or non-monetary currency which the player may utilize to initiate a play of a game and/or obtain another benefit. In one such embodiment, the data may be associated with a quantity of monetary credits that may be wagered on one or more plays of one or more primary games. In another such embodiment, the data may be associated with a quantity of promotional credits that may be wagered on one or more plays of one or more primary games. In another such embodiment, the data may be associated with a quantity of player tracking points.

In one embodiment, as mentioned above, the data communicated to/from the player's mobile phone may be associated with one or more redeemable units which a player may redeem to access a game. In one such embodiment, the data may be associated with a quantity of free plays of a game that the player may redeem (either presently or at a subsequent point in time) to play such free plays. In another such embodiment, the data may be associated with the unlocking of a bonus game which the player may redeem to play a bonus game which was previously unavailable for the player to play.

In one embodiment, as mentioned above, the data communicated to/from the player's mobile phone may be associated with one or more virtual goods associated with the player which the player has earned or acquired in one or more micro-transactions. In one such embodiment, the data may be associated with an avatar or virtual player that the player has previously created. In another such embodiment, the data may be associated with one or more virtual charms which the player associates with bringing good luck to the player. In certain embodiments, the gaming system enables the player to customize their avatar or virtual player using the player's mobile phone. It may be appreciated that since many available gaming systems are not configured to store any virtual goods, causing a player's mobile phone to store such virtual goods (and communicate these virtual goods to the gaming system) enables these available gaming systems to utilize such virtual goods. That is, such a configuration enables certain gaming systems (which are not configured to store virtual goods and thus not configured to utilize virtual goods) to utilize virtual goods by shifting the storage of these virtual goods to the player's mobile phone. Accordingly, gaming establishment operators using these types of gaming systems are enabled to offer to players similar features which utilize virtual goods and these gaming establishment operators are thus not at any disadvantage to other gaming establishment operators using different gaming systems that can store virtual goods.

In one embodiment, as mentioned above, the data communicated to/from the player's mobile phone may be associated with one or more player preferences, such as player personalization data and player permissions. In one such embodiment, the data may be associated with one or more betting preferences of the player, such as which numbers a player prefers to bet on in roulette or keno. In another such embodiment, the data may be associated with one or more display preferences of the player, such as a certain layout of the screen which the player prefers to view while playing. In another such embodiment, the data may be associated with one or more game preferences, such as which games and/or which gaming devices the player prefers to play or wants to try playing. It may be appreciated that, similar to virtual goods, since many available gaming systems are not configured to store any player preferences (and thus not configured to utilize such player preferences), causing a player's mobile phone to store such player preferences (and communicate these player preferences to the gaming system) enables these available gaming system to utilize such player preferences.

In one embodiment, as mentioned above, the data communicated to/from the player's mobile phone may be associated with data obtained from one or more components of the gaming system. In one such embodiment, the data may be obtained from a player tracking system. In this embodiment, the data may include the player's player tracking account number and any additional information stored by the player tracking system, such as the player's name, the player's address, the player's date of birth and/or any other information pertaining to the player or pertaining to tracking the player's game play activities. In operation of one such embodiment, when a player sits down at a gaming device, rather than inserting the player tracking card into a card reader to identify the player (as in known gaming systems), the player retrieves the stored player tracking account on the player's mobile phone. The player tracking account number may then be communicated to the gaming system to identify the player and track the player's wagering activities. Accordingly, this embodiment frees the player from having to carry a plurality of player tracking cards with them because the player's mobile phone functions as each of the player's player tracking cards.

In another embodiment, the data may be obtained from a tournament manager system. In this embodiment, the data may include which tournament(s) a player is currently enrolled in, a player's status in such tournaments, which upcoming tournaments the player may want to enroll in and/or any other information pertaining to one or more tournaments. In another embodiment, the data may be obtained from a gaming establishment reservation system. In this embodiment, the data may include information about player's stay at the gaming establishment, information about any upcoming reservations for the player and/or any other information pertaining to any reservations. In one such embodiment, the data may be obtained from a gaming establishment promotional system. In this embodiment, the data may include any promotions the player is currently enrolled in, any promotions the player may enroll in, any upcoming promotions for the player and/or any other information pertaining to any gaming establishment promotion or pertaining to a gaming establishment marketing department.

In one embodiment, in addition to or as an alternative to storing the gaming system generated data, the player's mobile phone may display certain of the gaming system generated data to the player, such as by displaying one or more service windows comparable to the service windows displayed by the gaming device. In this embodiment, the gaming system may enable a player to access one or more service windows (and thus avail themselves to certain service window benefits) even when the player has left the gaming device. Such a gaming system thus increases the mobility of one or more service windows which increases the player's level of excitement and enjoyment. In one such embodiment, the gaming system communicates data to the player's mobile phone and the player's mobile phone displays that communicated data to the player to inform the player of one or more game play events occurring in association with the player's gaming experience. For example, if a gaming system determines to provide a player a quantity of free plays of a game, such as free plays of a game funded by a gaming establishment's marketing department, the gaming system communicates data to the player's mobile phone regarding these free plays and the player's mobile phone displays to the player an indication that the player is eligible to redeem such free plays. In another example, if a player is currently enrolled in a tournament, the gaming system communicates data to the player's mobile phone regarding a change in the player's tournament status and the player's mobile phone displays to the player an indication of the change in tournament status.

In another such embodiment, the gaming system may communicate data to the player's mobile phone and the player's mobile phone may display that communicated data to the player to inform the player of one or more game play events and/or non-game play events which have occurred or may occur. For example, the gaming system sends data to the player's mobile phone to cause the player's mobile phone to notify the player of any tournament notifications, such as changes to a tournament's leader-board and/or tournament session times. In another example, if a player tracking system determines that a player has not played any games at a gaming establishment in a designated period of time, in an effort to draw the player to the gaming establishment, the gaming system sends data to the player's mobile phone to cause the player's mobile phone to notify the player of a limited time offer of a complementary dinner at a restaurant located at the gaming establishment. In another example, if a gaming establishment reservation system determines that a reservation at a designated restaurant has become available, the gaming system communicates data to the player's mobile phone regarding this open reservation and the player's mobile phone displays to the player an indication of this reservation. In this example, if the player determines to take the reservation, the player's mobile phone enables the player to accept the reservation and communicates data regarding the accepted reservation to the gaming establishment reservation system. In another example, if a gaming establishment reservation system determines that a player's hotel room has become available, the gaming system communicates data to the player's mobile phone regarding this availability and the player's mobile phone displays to the player an indication of this availability. It may be appreciated that while certain available gaming systems inform the player of one or more non-game play events (and/or one or more game play events) and/or offer certain benefits to a player via one or more applications run in one or more service windows displayed to the player at a gaming device, the utilization of such service windows requires the player to remain at the gaming device. Accordingly, at least these embodiments of the present disclose enables the player to utilize the same service window application(s) on the player's mobile phone and thus does not require the player to remain at the gaming device.

In another embodiment, the present disclosure may enable a player to utilize their mobile phone in association with a player's play at a gaming table. In one such embodiment, when a player sits down at a table position of a gaming table, the player may utilize their mobile phone to take a picture of a bar code at that table position. In this embodiment, the player's mobile phone then communicates data representing this picture to the gaming system. Upon receipt of this data, the gaming system associates or otherwise registers the player with the games played at the table position of the gaming table. Such association or registration of the player (via the player's mobile phone) with the player's play at the gaming table may enable the player to receive one or more benefits associated with their play. For example, identifying the player by their mobile phone enables a gaming establishment to identify players (and provided player tracking points and other benefits to such players) that would otherwise not be identified possibly because such player's may deem the amount they are wagering at the table games to be too small to track and/or because such player's want to avoid drawing attention to themselves by handing their player tracking card to a dealer. Moreover, such association or registration of the player (via the player's mobile phone) with the player's play at the gaming table may enable the gaming system to identify the player's preferences (e.g., identifying the player's preferred type of cocktails and automatically ordering the preferred cocktail to be delivered to the player at the gaming table) and/or identify the player's location to enable friends and/or family members of the player to locate the player at the gaming table. Furthermore, such association or registration of the player (via the player's mobile phone) with the player's play at the gaming table may enable the gaming system to provide the player one or more service window applications when the player is away from a gaming device. In this embodiment, because one or more service window applications are communicated to and run by the player's mobile phone, the gaming system may provide the player at the gaming table with certain service window related benefits typically associated with players playing at gaming devices.

In another embodiment, the present disclosure may enable a player to utilize their mobile phone in association with planning their gaming experience. For example, when a player determines that someone else is currently playing a gaming device they want to play (or determines that someone else they want to avoid is currently playing a gaming device near the gaming device they want to play), the player sends a message, such as a text message, to the gaming system indicating which gaming device they want to play. In this example, when the gaming system determines that the gaming device is available to be played by the player, the gaming system may communicate a notification to the player's mobile phone to inform the player that the gaming device they want to play is available. In one version of this example, the gaming system sends data to the player's mobile phone to enable the player to reserve, from the player's mobile phone, use of the available gaming device. In another example, the gaming system may communicate a map to the player's mobile phone which includes all of the locations in the gaming establishment where a designated gaming device or type of gaming device might be found (and whether each gaming device is currently being played). In another example, if the gaming system determines that a seat at a poker table becomes available, the gaming system sends data to the player's mobile phone to cause the player's mobile phone to notify the player of the availability and/or location of the poker table. In one version of this example, the gaming system sends data to the player's mobile phone to enable the player to reserve, from the player's mobile phone, the available seat at the poker table.

In another embodiment, rather than utilizing a player's mobile phone to identify a player and track a player's gaming activities, the gaming system may utilize a player's mobile phone to track the gaming activities of an anonymous player. In this embodiment, rather than tracking the gaming activity associated with a player associated with a player tracking account, the gaming system may track the gaming activity associated with a mobile phone utilized by an anonymous player. Such tracking of the gaming activity of the anonymous player may enable the player to earn one or more benefits, such as player tracking points or enrollment in gaming establishment promotions, typically reserved for identified players. It may be appreciated that at least these embodiments of the present disclose may enable certain players that are hesitant to register with a gaming establishment (which may enable a gaming establishment to identify the player and identify the player's gaming activity) to avoid registering with the gaming establishment while still earning benefits as if they were registered.

In one embodiment, the player's mobile phone may function in an anonymous mode and an identified mode. In this embodiment, when in the anonymous mode, the mobile phone is identified, but the player associated with the mobile phone remains unidentified. When in the identified mode, the player associated with the mobile phone is identified. In one such embodiment, the gaming system may enable the player to cause their mobile phone to function in the anonymous mode, such as if the player wants to remain anonymous at certain gaming establishments, or the identified mode, such as if the player wants to be identified at certain other gaming establishments.

It may be appreciated that in different embodiments, the gaming system may be configured to implement one, a plurality of or each of the mobile phone utilizing features disclosed herein. In these embodiments wherein the gaming system may implement more than one feature which utilizes a mobile phone, the gaming system may implement such mobile phone utilizing features sequentially, simultaneously, overlappingly and/or concurrently.

It should also be appreciated that while the player's credit balance, the player's wager, and any awards described herein are displayed as an amount of monetary credits or currency in certain of the embodiments described below, one or more of such player's credit balance, such player's wager, and any awards provided to such a player may be for non-monetary credits, promotional credits, and/or player tracking points or credits. It should be further appreciated that while certain of the embodiments described herein refer to implementing the present disclosure utilizing a mobile phone, any suitable mobile device, such as a mobile or cellular phone, a smart phone, a laptop computer, a handheld device (e.g., a personal digital assistant ("PDA")), a portable computing device, or another mobile computerized platform may be utilized in association with the present disclosure.

It may be appreciated that in different embodiments, one or more of:

i. how data is communicated from a gaming system to a mobile phone;

ii. how data is communicated from a mobile phone to a gaming system;

iii. which types of data are communicated from a gaming system to a mobile phone;

iv. which types of data are communicated from a mobile phone to a gaming system;

v. which types of data are stored by a mobile phone;

vi. when a mobile phone information request occurs;

vii. when a mobile phone communication termination event occurs;

viii. which players are enabled to store gaming system generated data on their mobile phones;

ix. which types of mobile phones are enabled to store gaming system generated data;

x. any determination disclosed herein;

may be predetermined, randomly determined, randomly determined based on one or more weighted percentages, determined based on a generated symbol or symbol combination, determined based on a random determination by the central controller, determined based on a random determination at the gaming system, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

It may be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one processor; and at least one memory device which stores a plurality of instructions, which when executed by the at least one processor, cause the at least one processor to:

in addition to causing the at least one display device to display any play of a wagering game, cause the at least one display device to display at least one event in a service window, said at least one displayed event associated with at least one controller determination, and after causing the at least one display device to display the at least one event in the service window, cause data associated with the at least one displayed event to be communicated to a mobile device which stores the data associated with the at least one displayed event.

2. The gaming system of claim 1, wherein the data associated with the at least one displayed event includes data selected from the group consisting of: data associated with a player tracking system, data associated with an anonymous player, data associated with a gaming establishment reservation system, data associated with at least one tournament, data associated with at least one player preference, data associated with at least one virtual good, data associated with at least one bonus game, and data associated with content available for a player to access.

3. The gaming system of claim 1, wherein when executed by the at least one processor, the plurality of instructions cause the at least one processor to receive the stored data from the mobile device upon an occurrence of a mobile device information request.

4. The gaming system of claim 1, wherein when executed by the at least one processor, the plurality of instructions cause the at least one processor to cause the mobile device to display the service window.

5. The gaming system of claim 1, wherein the mobile device is a mobile phone.

6. The gaming system of claim 1, which includes an acceptor, and a cashout device, wherein when executed by the at least one processor, the plurality of instructions cause the at least one processor to: responsive to a physical item being received via the acceptor, establish a credit balance based, at least in part, on a monetary value associated with the received physical item, and responsive to a cashout input being received via the cashout device, cause an initiation of any payout associated with the credit balance.

7. A method of operating a gaming system, the method comprising:

in addition to any display, via at least one display device, of any play of any wagering game, causing a display, via the at least one display device, of at least one event in a service window, said at least one displayed event associated with at least one controller determination, and after causing the display of the at least one event in the service window, causing, by at least one processor, data associated with the at least one displayed event to be communicated to a mobile device which stores the data associated with the at least one displayed event.

8. The method of claim 7, wherein the data associated with the at least one displayed event includes data selected from the group consisting of: data associated with a player tracking system, data associated with an anonymous player, data associated with a gaming establishment reservation system, data associated with at least one tournament, data associated with at least one player preference, data associated with at least one virtual good, data associated with at least one bonus game, and data associated with content available for a player to access.

9. The method of claim 7, further comprising receiving the stored data from the mobile device upon an occurrence of a mobile device information request.

10. The method of claim 7, further comprising causing the mobile device to display the service window.

11. The method of claim 7, wherein the mobile device is a mobile phone.

12. The method of claim 7, wherein a credit balance is increasable based on any awards associated with any plays of any wagering games displayed via the at least one display device, said credit balance being increasable via an acceptor of a physical item associated with a monetary value, and said credit balance being decreasable via a cashout device.

13. The method of claim 7, which is provided through a data network.

14. The method of claim 13, wherein the data network is an internet.

15. A gaming system server comprising:

at least one processor; and at least one memory device which stores a plurality of instructions, which when executed by the at least one processor, cause the at least one processor to:

in addition to any play of a wagering game displayed via at least one display device, cause the at least one display device to display at least one event in a service window of the at least one display device, said at least one displayed event associated with at least one controller determination, and after displaying the at least one event in the service window of the at least one display device, cause data associated with the at least one displayed event to be communicated to a mobile device which stores the data associated with the at least one displayed event.

16. The gaming system server of claim 15, wherein the data associated with the at least one displayed event includes data selected from the group consisting of: data associated with a player tracking system, data associated with an anonymous player, data associated with a gaming establishment reservation system, data associated with at least one tournament, data associated with at least one player preference, data associated with at least one virtual good, data associated with at least one bonus game, and data associated with content available for a player to access.

17. The gaming system server of claim 15, wherein when executed by the at least one processor, the plurality of instructions cause the at least one processor to receive the stored data from the mobile device upon an occurrence of a mobile device information request.

18. The gaming system server of claim 15, wherein when executed by the at least one processor, the plurality of instructions cause the at least one processor to cause the mobile device to display the service window.

19. The gaming system server of claim 15, wherein the mobile device is a mobile phone.

20. The gaming system server of claim 15, wherein a credit balance is increasable based on any awards associated with any plays of any wagering games displayed via the at least one display device, said credit balance being increasable via an acceptor of a physical item associated with a monetary value, and said credit balance being decreasable via a cashout device.

* * * * *